US010967236B2

(12) United States Patent
Sosin et al.

(10) Patent No.: US 10,967,236 B2
(45) Date of Patent: Apr. 6, 2021

(54) AIDS FOR CROQUET: PRACTICE TRAINING AIDS AND "ON MALLET" PLAYING AIDS

(71) Applicants: Howard Brian Sosin, Palm Beach, FL (US); David Thomas Bent, Port St. Lucie, FL (US)

(72) Inventors: Howard Brian Sosin, Palm Beach, FL (US); David Thomas Bent, Port St. Lucie, FL (US)

( * ) Notice: Subject to any disclaimer, the term of this patent is extended or adjusted under 35 U.S.C. 154(b) by 0 days.

(21) Appl. No.: 16/593,071

(22) Filed: Oct. 4, 2019

(65) Prior Publication Data

US 2020/0030676 A1 Jan. 30, 2020

Related U.S. Application Data

(62) Division of application No. 15/444,173, filed on Feb. 27, 2017, now Pat. No. 10,471,321.

(51) Int. Cl.

| | |
|---|---|
| ***A63B 69/00*** | (2006.01) |
| ***A63B 59/60*** | (2015.01) |
| *A63B 102/36* | (2015.01) |
| *A63B 71/06* | (2006.01) |

(52) U.S. Cl.

CPC ..... *A63B 69/00* (2013.01); *A63B 59/60* (2015.10); *A63B 2071/0694* (2013.01); *A63B 2102/36* (2015.10); *A63B 2208/0204* (2013.01)

(58) Field of Classification Search

CPC . A63B 69/00; A63B 59/60; A63B 2071/0694; A63B 2102/36; A63B 2208/0204

USPC ..... 473/150, 257, 260, 261, 265, 410, 420

See application file for complete search history.

(56) References Cited

U.S. PATENT DOCUMENTS

| | | | | |
|---|---|---|---|---|
| D588,226 | S * | 3/2009 | Brown | D21/794 |
| 8,083,616 | B2 * | 12/2011 | Cameron | A63B 57/353 473/406 |
| 10,471,321 | B2 * | 11/2019 | Sosin | A63B 69/00 |
| 2005/0148411 | A1 * | 7/2005 | Corbin | A63B 67/002 473/410 |
| 2018/0369676 | A1 * | 12/2018 | Uhm | A63B 71/0622 |

* cited by examiner

*Primary Examiner* — Nini F Legesse

(74) *Attorney, Agent, or Firm* — Ingram IP Law, P.A.

(57) ABSTRACT

The technology provides practice aids for developing croquet skills and on-mallet playing aids for improving croquet play. The practice aids are used while practicing croquet and offer benefits such as immediate feedback and practice shot repeatability. The practice aids may include a swing trainer, a single ball shot trainer, a croquet shot maker, a cannon shot maker, a mallet alignment tool, a take-off trainer, a hoop maker, and a wiring trainer. The on-mallet playing aids are used while practicing and during croquet games since the rules of croquet allow a player to mark a mallet. The on-mallet playing aids offer benefits such as improved in-game shot setup and improved shot precision. The on-mallet playing aids may include a single ball shot playing facilitator, a take-off playing facilitator, and a croquet-shot playing facilitator. The practice aids and the on-mallet playing aids may offer different ways of achieving a same result.

16 Claims, 12 Drawing Sheets

AIDS FOR CROQUET: PRACTICE TRAINING AIDS AND "ON MALLET" PLAYING AIDS

CROSS REFERENCE TO RELATED APPLICATIONS

This divisional application claims priority to U.S. patent application Ser. No. 15/444,173 filed on Feb. 27, 2017, the complete disclosure of which is incorporated herein by reference in its entirety.

FIELD OF THE TECHNOLOGY

The present technology broadly relates to novel implements used to enhance performance of a game, more specifically to novel implements used to enhance performance of a game that employs balls and an instrument for striking a ball, and still more specifically to novel practice training aids and on-mallet playing aids used to enhance playing of croquet.

BACKGROUND OF THE TECHNOLOGY

Croquet is a game that involves hitting balls with a mallet. There are several types of shots in croquet. A first shot type is called a "single ball shot" and involves causing the mallet to hit a ball. The single ball shot may direct a ball toward a particular location either on or off of the croquet court such as toward or through a hoop (the international name) or a wicket (the American name); at a peg (international name) or at a stake (American name); or toward another ball. When directed at another ball, a player's goal may be simply to just touch ("roquet") the second ball (the "object" ball) or to move ("rush") the object ball a particular distance, either straight ahead (a "straight" rush) or at an angle (a "cut" rush).

A second shot type is called a "croquet shot." After one ball hits another, the rules of croquet require two actions. First, the hitting or "striker" ball must be picked up and placed in contact with the struck or "croquet" ball. The contact point may be anywhere on the croquet ball at the selection of the player. Further, the rules require the striker and croquet balls to remain in contact prior to the croquet shot. Second, the player must use his mallet to hit the striker ball and only the striker ball such that both balls move or at least shake. Impacting the striker ball usually causes both balls to advance to new locations. The croquet shot causes both balls to travel certain distances and may end up separating the balls by a desired angle. A "straight croquet" shot occurs if both balls travel in basically a same direction with different distances. A "split" shot occurs if both balls travel different directions and distances.

One strategy employed during a croquet shot involves moving the croquet ball a small distance or causing it only to shake during take-off. When these shots cause the two balls to deviate by approximately 90 degrees they are called "take-offs." Another strategy employed during either a croquet shot or a single ball shot is called "peeling," which involves causing a ball, other than a player's own ball, to run to its next hoop and thereby score a point for the ball. A peel can be accomplished with a rush shot, a croquet shot, or a take-off.

A third shot type is called a "cannon shot." The cannon shot occurs when a ball is rushed to a boundary and settles directly behind another ball such that the two balls seek to occupy a same space. In this case, the croquet shot is set up as discussed above, with the striker ball contacting the croquet ball. Furthermore, a third ball is placed in contact with the croquet ball such that a gap is provided between the third ball and the striker ball. The gap may be small or large at the option of the player.

Shots in croquet require extreme precision. For example, a single ball shot aimed to pass through a hoop typically has a clearance of no more than ⅛" on each side. In tournament play, the clearance may be as little as 1/64". When aiming one ball at another ball in an attempt to roquet or rush the object ball, misaligning the striker ball by ⅛" may cause it to entirely miss an object ball positioned barely 5' away.

There are at least three skills that must be mastered to consistently and correctly hit a croquet shot. First, the croquet shot should be hit at a correct angle. This involves forming a correct angle between (1) a line that extends through the centers of the touching striker and croquet balls and (2) a line that extends through the center of the striking ball along a path of the striking mallet. Second, the striker ball should be hit with a proper force. Third, the player should use the correct "shot type." In other words, the player should correctly angle the face of the mallet during impact, should hit a correct contact point on the striker ball with the mallet, and should direct the mallet into the striker ball at the correct path angle. A small mistake in any of these three areas may cause a croquet shot to fail. This may end a turn or, even worse, lose a game.

It takes years for a croquet player to understand and gain the skills needed to execute shots during a game. While there are books and videos that describe, illustrate, and even demonstrate various single ball shots and croquet shots, there are virtually no aids that train a player in execution of these shots. Furthermore, there are virtually no practice training aids that provide feedback to indicate and fix errors. Additionally, there are no playing aids that aid actual play. Other drawbacks exist.

DETAILED DESCRIPTION OF THE TECHNOLOGY

Figure 1:
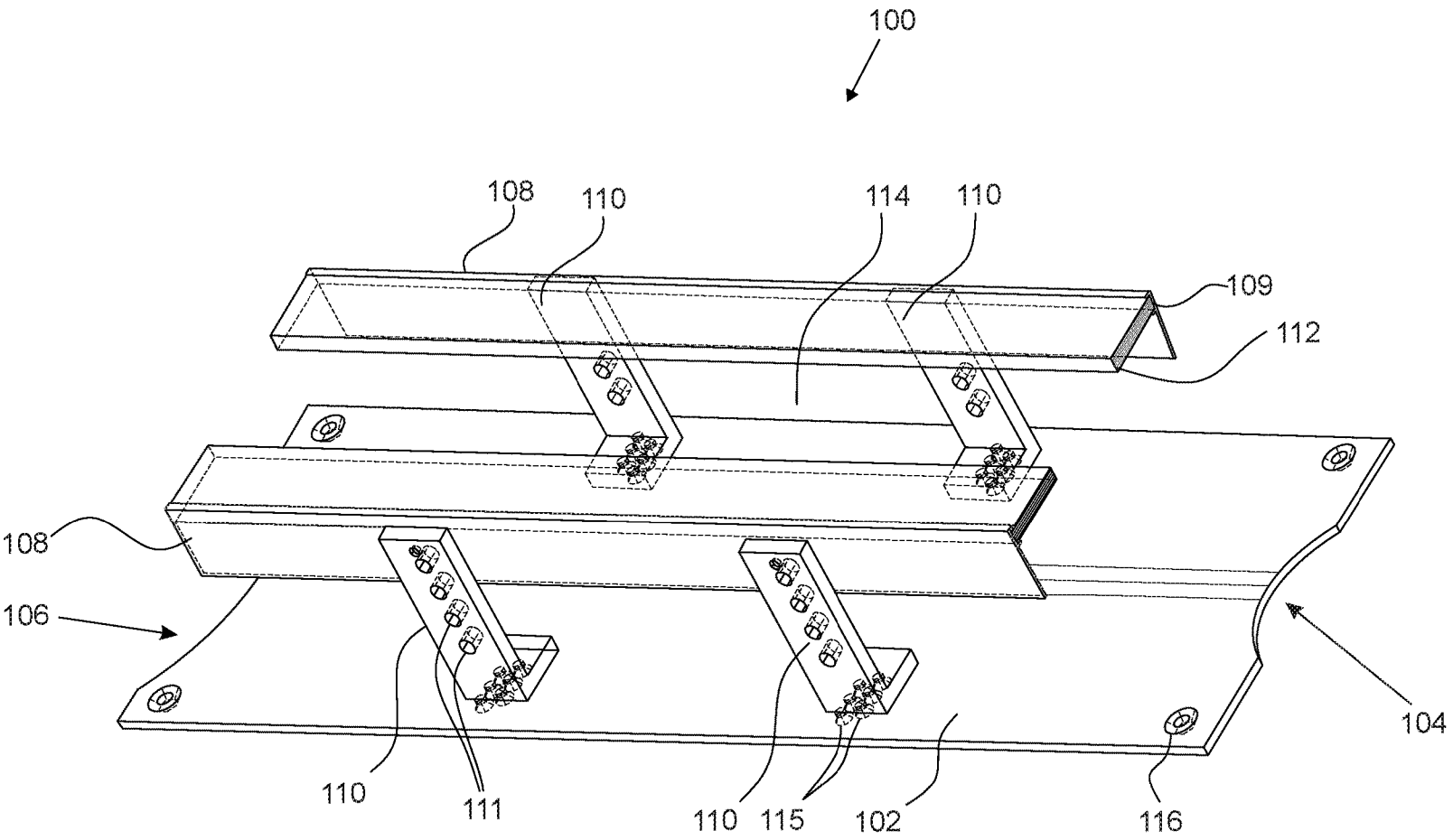
FIG. 1 illustrates a swing trainer according to one example of the technology.

It will be appreciated that for simplicity and clarity of illustration, where appropriate, reference numerals may be repeated among the different figures to indicate corresponding or analogous elements. In addition, numerous specific details are set forth in order to provide a thorough understanding of the examples described herein. However, it will be understood by those of ordinary skill in the art that the examples described herein may be practiced without these specific details. In other instances, methods, procedures, and components have not been described in detail so as not to obscure the related relevant feature being described. Also, the description is not to be considered as limiting the scope of the examples described herein. The drawings are not necessarily to scale and the proportions of certain parts may have been exaggerated to better illustrate details and features of the present disclosure. Those skilled in the art with access to the teachings provided herein will recognize additional modifications, applications, and examples within the scope thereof and additional fields in which the technology would be of significant utility.

Unless defined otherwise, technical terms used herein have the same meaning as is commonly understood by one of ordinary skill in the art to which this disclosure belongs. The terms "first," "second," and the like, as used herein do not denote any order, quantity, or importance, but rather are used to distinguish one element from another. Also, the terms "a" and "an" do not denote a limitation of quantity, but rather denote the presence of at least one of the referenced items. The term "or" is meant to be inclusive and means either, any, several, or all of the listed items. The terms "comprising," "including," and "having" are used interchangeably in this disclosure. The terms "comprising," "including," and "having" mean to include, but are not necessarily limited to the things so described.

The terms "connected" and "coupled" can be such that the objects are permanently connected or releasably connected. The term "substantially" is defined to be essentially conforming to the thing that it "substantially" modifies, such that the thing need not be exact. For example, substantially 2 inches (2") means that the dimension may include a slight variation.

The technology described herein may be employed to develop croquet skills and improve croquet play. According to one example, the technology may include practice aids that develop croquet skills and on-mallet playing aids that improve croquet play. As will be described below, the practice aids and the on-mallet playing aids may offer different ways of achieving a same result. According to one example, the practice aids are intended for use while practicing and offer benefits such as immediate feedback and practice shot repeatability, among other benefits. The on-mallet playing aids are intended for use while practicing and during croquet games since the rules of croquet allow a player to mark a mallet. The on-mallet playing aids offer benefits such as improved in-game shot setup and improved shot precision, among other benefits.

According to one example, the practice aids may include a swing trainer, a single ball shot trainer, a croquet shot maker, a cannon shot maker, a mallet alignment tool, a take-off trainer, a hoop maker, and a wiring trainer, among other practice aids. According to one example, the practice aids may be constructed from a material that withstands repeated impacts from a croquet mallet. For example, the practice aids may be constructed from metal, plastic, wood, or the like. According to one example, the practice aids may be constructed from LEXAN™ polycarbonate sheets having a thickness in a range of 2/32" to 4/32". According to one example, the swing trainer teaches a player to position a mallet face square to a target line prior to impact. Additionally, the swing trainer may teach a player to hit a ball at a desired location such as dead center. According to one example, the single ball shot trainer enhances player skills by including markings that indicate where a ball is aimed. When aiming a ball across a distance, the single ball shot trainer may be used with a guide line such a chalk line, a laser line, or the like, to confirm an alignment is accurate. For example, the chalk line may be snapped between a starting point and a target point to temporarily mark a path with chalk dust. Alternatively, a laser may be applied to the single ball shot trainer or the swing trainer to allow sighting a line between a starting point and a target point. Alternatively, the laser may be applied to the mallet head to allow sighting a line between a starting point and a target point. Furthermore, the single ball shot trainer may include a marking that identifies where the mallet face should impact a ball to send it in the aimed direction. According to one example, the croquet shot maker is configured to place the striker ball in direct physical contact with the croquet ball. The croquet shot maker may include an aiming marker that extends below the centers of the striker and croquet balls. According to one example, the aiming marker may identify an aiming direction for the croquet ball. According to one example, the croquet shot maker may include angle markers that provide guidance on where to impact the striker ball with the mallet to correctly send the striker ball to a desired location.

According to one example, the cannon shot maker is configured to place a third ball in direct physical contact with the croquet ball such that a gap is provided between the third ball and the striker ball. In this way, the cannon shot maker allows practice of a three ball cannon shot. The cannon shot maker may include an aiming marker that extends below the centers of the third ball and the croquet ball. According to one example, the aiming marker may identify an aiming direction for the third ball with a first arrow while identifying a corresponding angle marker on the croquet shot maker with a second arrow. Accordingly, croquet players may learn to associate a desired gap between the striker ball and the third ball with a specific angle formed by the intersection of a first line extending between the centers of the striker ball and the third ball and a second line extending between the centers of the striker ball and the croquet ball.

According to one example, the mallet alignment tool may include a marker such as a line or arrow that identifies a recommended striking point and swing direction for the mallet. The mallet alignment tool may be used together with the croquet shot maker to identify where to aim the mallet face to impact through the center of the striker ball. According to one example, the mallet alignment tool marker may be aligned with a selected angle of the croquet shot maker to cause the striker ball to travel in a desired direction.

According to one example, the take-off trainer may be an L-shaped tool that includes markings along the longer arm. The markings identify where the striker ball should be aimed during impact to control a distance the striker ball travels relative to the croquet ball.

According to one example, the hoop maker includes markings that identify a correct aiming point for straight and angled hoop shots.

According to one example, the wiring trainer mimics both a hoop and a peg. The wiring trainer facilitates the practice of wiring, which involves a strategy of placing two balls such that they are blocked from hitting one another by the peg or the legs of a hoop.

As described in detail below, the practice or training aids may be used individually or in association with other practice aids. According to one example, the practice aids are intended for use while practicing and offer benefits such as immediate feedback and practice shot repeatability, among other benefits. According to one example, the practice aids may be used on different surfaces including a lawn, a floor, a carpet, or the like.

According to one example, all of the practice or training aids are designed to be secured to the playing surface. This feature allows a shot set-up to remain constant such that a shot approach may be repeated and studied. This feature also allows a player to experiment and compare different shot approaches. For example, while the balls are resting in the croquet shot maker, a player may maintain an angle corresponding to the strike point on the striker ball constant during successive mallet strikes. The player may investigate how different face angles and variations to the angle corresponding to the strike point on the striker ball alter an angle the striker and the croquet balls deviate form each other after impact. In this way, a player may customize his swing based on factors such as swing strength, mallet weight, or the like. According to one example, maintaining a constant and repeatable shot set-up is also invaluable to learning an effect of "pull" in peel shots, where pull is a deviation in the path of the croquet ball caused by the type of shot selected.

According to one example, on-mallet playing aids have a long history in croquet. For example, the top of a mallet head may include an aiming line that runs down the center in a lengthwise direction to facilitate aiming during single ball shots. According to one example, mallet heads may range in length from 9"-12" long and mallet shafts may range in length from 32"-38" long. Some mallets, such as those used in the American game may have a mark or line on the mallet head indicating 9" to allow a player that hits a ball out of the court to accurately replace a ball 9" in from the edge of the court. Other mallets, such as those used in the International game may have a mark on the shaft indicating 36" to allow a player that hits a ball out of the court to accurately replace a ball 36" in from the edge of the court. When a combined length of the mallet and the shaft is shorter than 36", a mark may be provided a few inches from the end of the shaft to indicate a length beyond the shaft that is needed to reach 36". Furthermore, some players mark the sides of their mallet head with a dot or line to indicate a length that is ½ the diameter of a standard croquet ball. This marking may be used to help aim split shots. The on-mallet playing aids described herein are provided to augment and extend capabilities of known on-mallet playing aids. According to one example, the on-mallet playing aids described herein are optimized for use with mallet heads having parallelogram-shaped sides.

According to one example, the on-mallet playing aids described herein offer tools for use during games that achieve similar results to the practice aids described herein. For example, the on-mallet playing aids may include a single ball shot playing facilitator, a take-off playing facilitator, and a croquet-shot playing facilitator, among other on-mallet playing aids. According to one example, the single ball shot playing facilitator may include one or more marks provided on the mallet face. For example, the marks may be provided on a face or on a side of the mallet to indicate a desired dimension such as half (½) the diameter of a ball used to play croquet. According to one example, all balls used to play croquet include the same dimensions and are typically distinguished based on ball color. As a point of reference, half the diameter of a standard ball used to play croquet is substantially 1.8125". The on-mallet playing aids are intended for use while practicing and during croquet games and offer benefits such as improved in-game shot setup and improved shot precision, among other benefits.

A conventional technique for setting up a take-off croquet shot included placing the mallet head in contact with the balls such that a line extending along a center of the mallet shaft extended through a contact point of the two balls such that the mallet shaft was oriented to point in a direction the player desired the croquet ball to travel. In contrast, the technology described herein provides a take-off playing facilitator for setting up a take-off croquet shot by placing the mallet head in contact with the balls such that a line extending along the center of the mallet shaft extends through a center of the to-be croquet ball. Furthermore, the mallet shaft may be oriented to be substantially perpendicular to a line that extends through the centers of both balls. According to one example, the take-off playing facilitator may include markers that extend along the center of the mallet shaft such that they mirror the markers identified in the take-off trainer. For example, the take-off playing facilitator may include a line that extends along the center of the shaft having a pattern of markers provided on the mallet shaft to identify desirable aiming points for use during take-off shots.

According to one example, the croquet-shot facilitator may include a pattern of lines provided along one or more sides of the mallet face. The mallet face may be positioned proximate to the striker ball during a croquet game to allow a player to sight aiming lines onto the striker ball. The player may then impact the striker ball at the selected angle to cause the croquet ball to travel in a desired direction. According to one example, the croquet shot facilitator may be removably placed on the mallet with attachments, decals, or the like. Alternatively, the croquet shot facilitator may be permanently etched into or drawn on the mallet. One of ordinary skill in the art will readily appreciate that some combination of removable and permanent markings may be applied to the mallet.

Taking a step back from the practice aids and the on-mallet playing aids, a croquet player learns a variety of ways to strike a ball with a mallet depending on a given situation. A croquet player appreciates that a standard croquet ball weighs substantially 16 oz. and that the dimensions of a standard croquet court are 84' by 105'. The player develops shots using a mallet that typically weighs between 2.5 and 3.5 lbs. The player may send one ball during a single ball shot or two balls during a croquet shot from a few inches to approximately 135', which is the longest diagonal distance of a croquet court. For example, a shot may involve striking a ball through its center using a contact point located at a center of the mallet face (measured horizontally). Alternatively, a shot may involve striking a ball through its center using a contact point located above or below a center of the mallet face (measured vertically). Still further, a shot may involve striking a ball proximate to its center using a contact point located above or below a center of the mallet face. One of ordinary skill in the art will readily appreciate that the variety of ways used to strike the ball with the mallet may be selected to provide desired properties to the ball such as backspin, topspin, or the like.

During a full swing stroke and prior to striking a ball, a player may swing the head of a croquet mallet several feet in backward and then forward directions. For example, a player may swing the head of a croquet mallet 36 inches or more in backward and then forward directions prior to striking a ball. A swing style is idiosyncratic to a player in a sense that no two players have identical swings. With that said, some croquet players consider it elegant and beneficial to swing the mallet head along a single plane such that the projection of the swing is a straight line along the ground throughout the backward and forward portions of the swing. Other players employ swings in which the mallet head is square at impact, but find it beneficial to have a swing that deviates from square during a segment or segments of the forward and backward motions. Regardless of a player's swing style, a croquet player should properly align the mallet relative to the ball at the point of impact in order to ensure that the mallet head correctly impacts the ball.

FIG. 1 illustrates a swing trainer 100 according to one example of the technology. The swing trainer 100 may include an elongated base 102. According to one example, the elongated base 102 may be a generally rectangular shape and may include concave cutouts 104, 106 on the short ends. As will be described in detail below, the concave cutouts 104, 106 may be dimensioned to allow the swing trainer 100 to be coupled to other practice aids. For example, the swing trainer 100 may be coupled to the single ball shot trainer or the croquet shot maker. According to one example, the base 102 may be dimensioned to be substantially 16" long and 6" wide. One of ordinary skill in the art will readily appreciate that the base 102 may be formed from other shapes and may include other dimensions.

According to one example, the swing trainer 100 may include rails 108 that are coupled to the base 102 using brackets 110. For example, the rails 108 may be coupled to the base 102 using "L"-shaped brackets 110. According to one example, the rails 108 may include a channel 109 that may fixedly secure a flexible strip or brush 112 therein. According to one example, the flexible strip may include a rubber strip, a felt strip, or the like. For example, the channel 109 may be a U-shaped channel or the like and the flexible strip or brush 112 may be fixedly secured to the channel 109 via an adhesive, a friction fit, a crimping mechanism, or the like. One of ordinary skill in the art will readily appreciate that the rails 108 may include other fastening mechanisms for fixedly securing the brush 112 thereto. According to one example, the channel 109 may extend substantially perpendicular from the rail 108 such that the brush 112 extends substantially perpendicular from the rail 108. According to another example, the channel 109 may extend at an angle relative to the rail 108 such that the brush 112 extends at an angle relative to the rail 108. According to yet another example, the channel 109 and flexible strip or brush 112 may include a plurality of channels and flexible strips or brushes that are oriented substantially perpendicular relative to the base 102. Alternatively, the channel 109 and flexible strip or brush 112 may include a plurality of channels and flexible strips or brushes that are oriented at one or more angles relative to the base 102. While the flexible strip or brush 112 is illustrated at an upper portion of the rail 108, one of ordinary skill in the art will readily appreciate that the flexible strip or brush 112 may be positioned at other locations along the rail 108 such as at middle or lower portions of the rail 108. Furthermore, the flexible strip or brush 112 may be positioned diagonal or zig-zag across the rail 108, among other designs. According to one example, the flexible strip or brush 112 may be positioned and oriented to guide the mallet along a path 114 defined between the rails 108.

According to one example, the swing trainer 100 includes a low profile design and a relatively short length for the path 114. Accordingly, the design of the swing trainer 100 accommodates both straight and idiosyncratic swing styles, while enforcing a proper alignment of the mallet head relative to the ball at impact, where it matters. For example, the swing trainer 100 may be designed to align the mallet head such that the mallet head is square with a short end of the base 102 prior to impact with the ball. According to one example, the rails 108 may be adjustable to modify a width of the path 114 and a height of the flexible strip or brushes 112 above the base 102 in order to allow or constrict deviations in the swing close to the instance of impact. In contrast, conventional swing trainers are designed to control the mallet throughout an entire swing, which limits their usefulness to a particular subset of croquet players. Conventional swing trainers may be counterproductive for players having idiosyncratic swing styles.

According to one example, the rails 108 of the swing trainer 100 may be mechanically coupled to the longer arm of the "L"-shaped brackets 110, which may include a plurality of holes 111. According to one example, the rails 108 may include a hole or other mechanism that aligns with a corresponding one of the plurality of holes 111 in the brackets 110. According to one example, a fastener such as a pin, a screw, or a quick release projection may be provided to mechanically secure the rails 108 to the brackets 110. According to one example, the rails 108 may be configured to slide up and down along the brackets 110 in order to adjust a height of the flexible strip or brushes 112 above the base 102. According to one example, each rail 108 may be adjusted individually to allow for individual adjustment of each flexible strip or brush 112.

According to another example, a short arm of the "L"-shaped brackets 110 may be mechanically coupled to the base 102. According to one example, the base 102 may include a plurality of holes 115 or other mechanism that aligns with a corresponding hole provided in the short arm of the "L"-shaped brackets 110. According to one example, a fastener such as a pin, a screw, or a quick release projection may be provided to mechanically secure the the brackets 110 to the base 102. According to one example, the "L"-shaped brackets 110 may be configured to slide along the base 102 such that the rails 108 modify a width of the path 114. According to one example, the path 114 may include different widths at different ends of the swing trainer 100.

According to one example, the brackets 110 may be configured to extend substantially perpendicular from the base 102. One of ordinary skill in the art will readily appreciate that the brackets 110 may be configured to extend at an angle relative to the base 102. According to one example, a player may adjust a height of the rails 108 above the base 102 and a width of the rails 108 relative to each other in order to customize an amount of feedback resistance provided through the mallet during a swing. For example, a player may adjust the swing trainer 100 to provide tight tolerance values between the mallet and the brushes 112 at a beginning of practice and may increase the tolerance values between the mallet and the brushes 112 during practice to lessen a dependence on the swing trainer 100. According to one example, failure of a player to accurately swing the mallet through the swing trainer 100 will cause the mallet to hit one or both of the brushes 112. According to one example, any contact between the mallet head and the brushes 112 will provide immediate feedback to the player through the mallet. The brushes 112 are selected such that any contact between the brushes 112 and the mallet will not cause pain to the player nor damage the mallet.

Furthermore, a player may adjust a height of the rails 108 above the base 102 and the width of the rails 108 relative to each other to accommodate mallets having different head sizes. For example, the brushes 112 may be set with a 2¼" gap to provide a 2" wide mallet head with ⅛" clearance on each side. Furthermore, the brushes 112 may be set at 1" above the base 102 or higher such as 3" above the base 102. According to one example, the brushes 112 may be kept at the same height above the base 102. Alternatively, while not shown, the brushes 112 may be tilted to encourage a jump shot. For example, an angle of the brushes 112 relative to the base 102 may be adjusted to customize an amount of feedback resistance provided during a jump shot. According to example, the swing trainer 100 may be adjusted such that a brush height proximate to the ball is small, while the brush height farther away from the ball is larger. Alternatively, the the swing trainer 100 may be placed on a declining surface to encourage a jump shot. For example, the swing trainer 100 may be placed on a wedge shaped surface or may include an elevating mechanism that lifts the rear portion of the base 102 to encourage a jump shot. According to one example, the elevating mechanism may include a threaded peg, kick stand, or the like. In this case, the player may step forward to facilitate the swing.

According to one example, the swing trainer 100 may be placed flat on a ground and may include anchor holes 116 that allow the swing trainer 100 to be removably secured to the ground. For example, the swing trainer 100 may be fixedly secured to the ground using anchors such as push-in screws, pins, tees, bolts, or the like. According to one example, the anchor holes 116 may include a beveled edge along its perimeter to allow the anchors to rest flush with an upper surface of the base 102. Alternatively, the swing trainer 100 may be used on a floor or carpet without being fixedly secured to the ground. According to one example, the swing trainer 100 may include a marker such as a center line that is provided down a middle of the path 114 to identify a desired path of the mallet during a swing. According to one example, the swing trainer 100 may include additional markers that are placed perpendicular to the center line to identify possible foot positions. In this way, the additional markers may facilitate a proper and repeatable stance.

Figure 2:
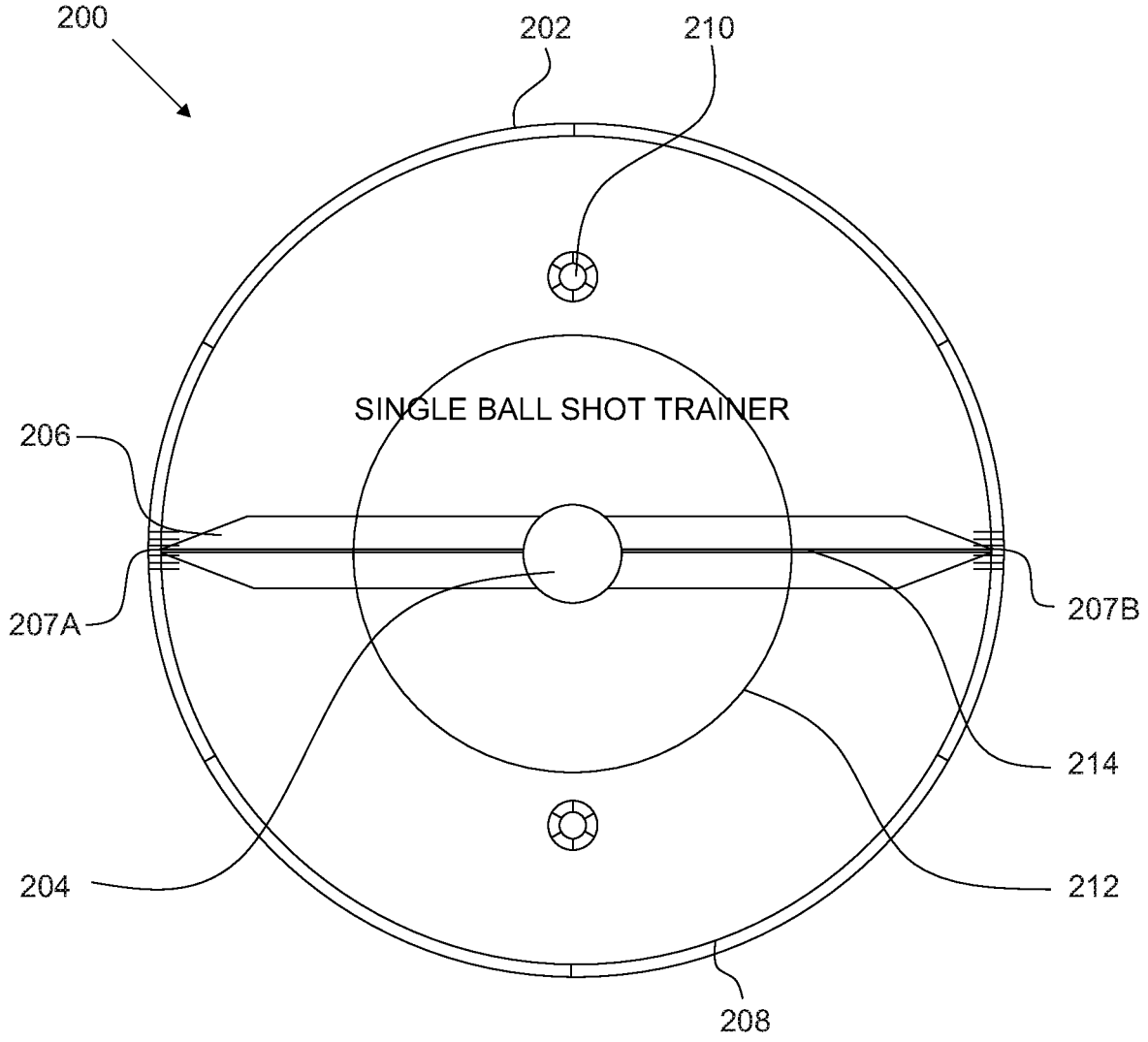
FIG. 2 illustrates a singe ball shot trainer according to one example of the technology.

FIG. 2 illustrates a single ball shot trainer 200 according to one example of the technology. According to one example, the single ball shot trainer 200 may include a disc-shaped body with an edge 202. According to one example, an aperture or hole 204 may be provided in the center of the single ball shot trainer 200, the hole 204 being dimensioned to receive a ball therein. According to another example, instead of the hole 204, the single ball shot trainer 200 may include an indentation at its center to maintain a ball therein. According to one example, an aim marker 206 may be provided that spans across a diameter and extends through the center of the single ball shot trainer 200. The aim marker 206 may include first and second outwardly pointing arrows 207A, 207B, respectively, that point toward the edge 202 at opposite sides of the diameter. According to one example, the aim marker 206 may identify an aiming line for a ball placed over the hole 204.

According to one example, the edge 202 may include a beveled or sloping surface 208 that allows a ball to roll on or off the ball shot trainer 200 without jumping, skidding, skipping, bouncing, or the like. According to one example, the hole 204 may include a beveled or sloping edge along its perimeter to allow a ball to roll out of the hole 204 without jumping, skidding, skipping, bouncing, or the like. Furthermore, the beveled or the sloping edge may be provided to promote touching with the ball. According to one example, the single ball shot trainer 200 may be placed flat on the ground and may include anchor holes 210 that allow the single ball shot trainer 200 to be removably secured to the ground. For example, the single ball shot trainer 200 may be fixedly secured to the ground using anchors such as push-in screws, pins, tees, bolts, or the like. According to one example, the anchor holes 210 may include beveled edges along their perimeters to allow the anchors to rest flush with an upper surface of the single ball shot trainer 200.

With respect to employing the single ball shot trainer 200 as a practice aid, it may be used for a single ball shot when two balls are separated by a distance and a player desires to send an object ball in a particular direction using a striker ball. In this case, a player may place the single ball shot trainer 200 below the object ball such that the object ball rests over the hole 204. According to one example, the first outwardly pointing arrow 207A may be aimed toward a selected target for the object ball. Once the single ball shot trainer 200 is properly aimed toward the selected target, it may be secured in place using anchors pushed into the ground through the anchor holes 210. Alternatively, if the player is practicing on a hard surface, the anchors may be omitted. According to one example, a chalk line may be snapped along the ground between the first outwardly pointing arrow 207A and the selected target to provide a guide line for the striker ball. In this way, the player may visually identify an actual path traveled by the striker ball relative to the guide line.

Next, a strike point may be determined on the object ball such that when the striker ball impacts the strike point on the object ball, the object ball will be sent toward the selected target. According to one example, the technology allows a player to perform the strike point determination in two-dimensions ("2-D") on the single ball shot trainer 200 rather than performing the strike point determination in three-dimensions ("3-D") on the actual object and striker balls. According to one example, the technology allows the player to determine the strike point by quickly visualizing the center of the striker ball in 2-D using the single ball shot trainer 200.

For example, the technology employs a circle 212 to represent a circumference of the object ball projected onto the single ball shot trainer 200. In this way, the center of the object ball is effectively collapsed down onto the single ball shot trainer 200 and is made to correspond with the center of the single ball shot trainer 200. According to one example, the edge 202 of the single ball shot trainer 200 represents a possible path that would be traced by the center of a striker ball that is collapsed down onto the single ball shot trainer 200 and made to abut and travel around the circle 212, which represents the circumference of the object ball. In other words, the edge 202 of the single ball shot trainer 200 may represent a trace made by the center of a striker ball when the circumference of the collapsed striker ball is made to abut and travel around the circumference of the collapsed object ball.

According to one example, the distance between the circle 212 and the edge 202 in a radial direction is substantially equal to half the diameter of the striker ball. Thus, the diameter of the single ball shot trainer 200 is substantially equal to twice the diameter of the object or striker balls.

According to one example, after the object and striker balls are depicted in 2-D on the single ball shot trainer 200, the strike point on the object ball may be determined with reference to the edge 202 and second outwardly pointing arrow 207B, which points in a direction opposite to the first outwardly pointing arrow 207A, is aimed toward the selected target. According to one example, the strike point may be found along the circle 212 at strike point 214 and may be projected upward onto the circumference of the object ball that rests over the hole 204. When the center of the striker ball passes over the edge 202 at the point of the second outwardly pointing arrow 207B, the periphery of the striker ball will impact the periphery of the object ball at the projection point that corresponds to the strike point 214.

According to one example, the diameter of a ball used to play croquet is substantially 3.625". Thus, the diameter of the circle 212 is substantially 3.625". Furthermore, the distance between the strike point 214 and the edge 202 is half the diameter of a ball or substantially 1.8125". With reference to FIG. 2, the edge 202 that encircles the circle 212 forms a second circle that is substantially 7.25" or twice the diameter of a ball used to play croquet. According to one example, a player may select a strike point anywhere along a circumference of the object ball in 3-D and may project the selected strike point onto the circle 212 to determine a 2-D representation of the strike point. In this way, a player may quickly determine a point along the edge 202 to aim the striker ball such that it directs the object ball to the selected target.

According to one example, a second single ball shot trainer 200 may be used to aim the striker ball toward the object ball. The second single ball shot trainer 200 may be constructed similar to the single ball shot trainer 200. In this arrangement, the second single ball shot trainer 200 may be placed under the striker ball and the first outwardly pointing arrow 207A may be aimed toward the selected target at the object ball. According to one example, the first outwardly pointing arrow 207A of the second single ball shot trainer 200 may be directed toward the second outwardly pointing arrow 207B of the single ball shot trainer 200. More particularly, the first outwardly pointing arrow 207A of the second single ball shot trainer 200 may be aimed such that the center of the striker ball passes over the edge 202 of the single ball shot trainer 200 at the point of the second outwardly pointing arrow 207B. Once the single ball shot trainer 200 is properly aimed toward the selected target, it may be secured in place using anchors pushed into the ground through the anchor holes 210. An aim accuracy may be reinforced by snapping a chalk line. Alternatively, if the player is practicing on a hard surface, anchors may be omitted. According to one example, the chalk line may be snapped along the ground between the first outwardly pointing arrow 207A of the second single ball shot trainer 200 and the second outwardly pointing arrow 207B of the single ball shot trainer 200 to provide a guide line for the striker ball. In this way, the player may visually identify an actual path traveled by the striker ball relative to the guide line. In this arrangement, the periphery of the striker ball will impact the periphery of the object ball at the projection point that corresponds to the strike point 214 of the single ball shot trainer 200.

According to one example, once the the single ball shot trainer 200 is paired with the second single ball shot trainer 200, the player may repeat practice shots more quickly without needing to go through a time consuming process of re-aiming the striking and object balls. Accordingly, these practice aids provide a more efficient use of practice time and offer improved feedback. According to one example, the improved feedback may result from the shot set-up remaining constant so a player may attribute repeatable or non-repeatable results to specific factors. In this way, a player may make minor adjustments to a swing or stance and observe immediate results in substantially real-time.

According to yet another example, the single ball shot trainer 200 may be used in association with the striker ball and not the object ball in order to aim the striker ball toward the object ball. In this arrangement, the single ball shot trainer 200 may be placed under the striker ball and the first outwardly pointing arrow 207A may be aimed toward the selected target at the object ball. According to one example, the first outwardly pointing arrow 207A of the single ball shot trainer 200 may be directed toward the object ball. More particularly, the first outwardly pointing arrow 207A of the single ball shot trainer 200 may be aimed such that the center of the striker ball passes a half diameter behind the desired strike point of the object ball. Once the single ball shot trainer 200 is properly aimed toward the selected target, it may be secured in place using anchors pushed into the ground through the anchor holes 210. Alternatively, if the player is practicing on a hard surface, anchors may be omitted. According to one example, this arrangement allows the player to focus on precisely aiming the striker ball toward an object ball that does not have practice aids.

Figure 3:
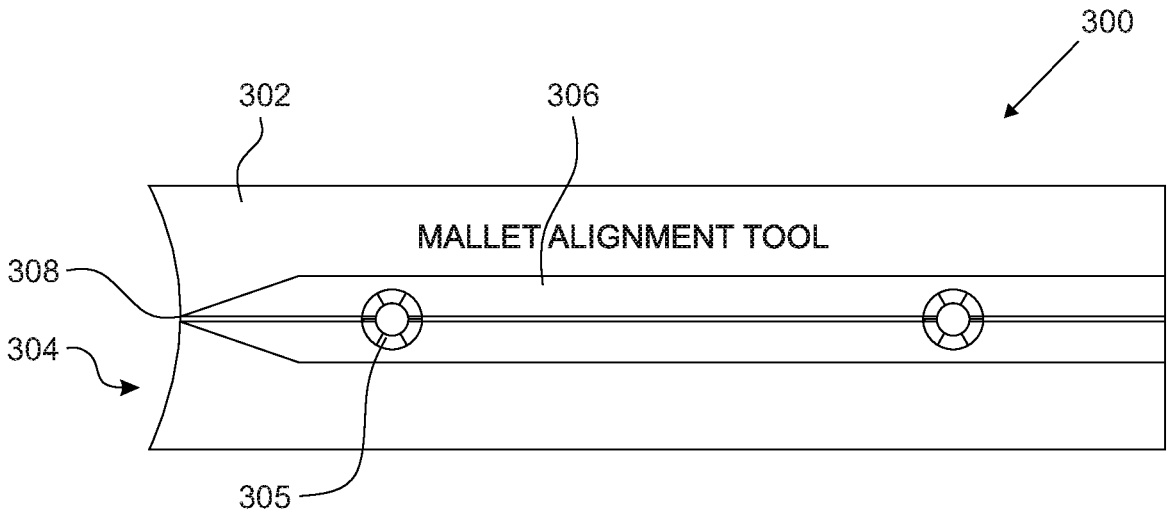
FIG. 3 illustrates a mallet alignment tool according to one example of the technology.

FIG. 3 illustrates a mallet alignment tool 300 according to one example of the technology. According to one example, the mallet alignment tool 300 may include a body having an elongated shape. According to one example, the mallet alignment tool 300 may have a generally rectangular shape and may include a concave cutout 304 on a short end. As will be described in detail below, the concave cutout 304 may be dimensioned to allow the mallet alignment tool 300 to be coupled to other practice aids. For example, the mallet alignment tool 300 may be coupled to the croquet shot maker, among other aids. According to one example, the mallet alignment tool 300 may be dimensioned to be substantially 7.25" long and 1.8125" wide. One of ordinary skill in the art will readily appreciate that the mallet alignment tool 300 may be formed from other shapes and may include other dimensions.

According to one example, the mallet alignment tool 300 may be placed flat on a ground and may include anchor holes 304 that allow the mallet alignment tool 300 to be removably secured to the ground. For example, the mallet alignment tool 300 may be fixedly secured to the ground using anchors such as push-in screws, pins, tees, bolts, or the like. According to one example, the anchor holes 305 may include a beveled edge along its perimeter to allow the anchors to rest flush with an upper surface of the mallet alignment tool 300. Alternatively, the mallet alignment tool 300 may be used on a floor or carpet without being fixedly secured to the ground. According to one example, the mallet alignment tool 300 may include a marker 306 such as a center line provided down a middle of the body to identify a desired path of the mallet during a swing. According to one example, the marker 306 may include an arrow 308 that points to a middle portion of an edge formed by the concave cutout 304.

Figure 4A:
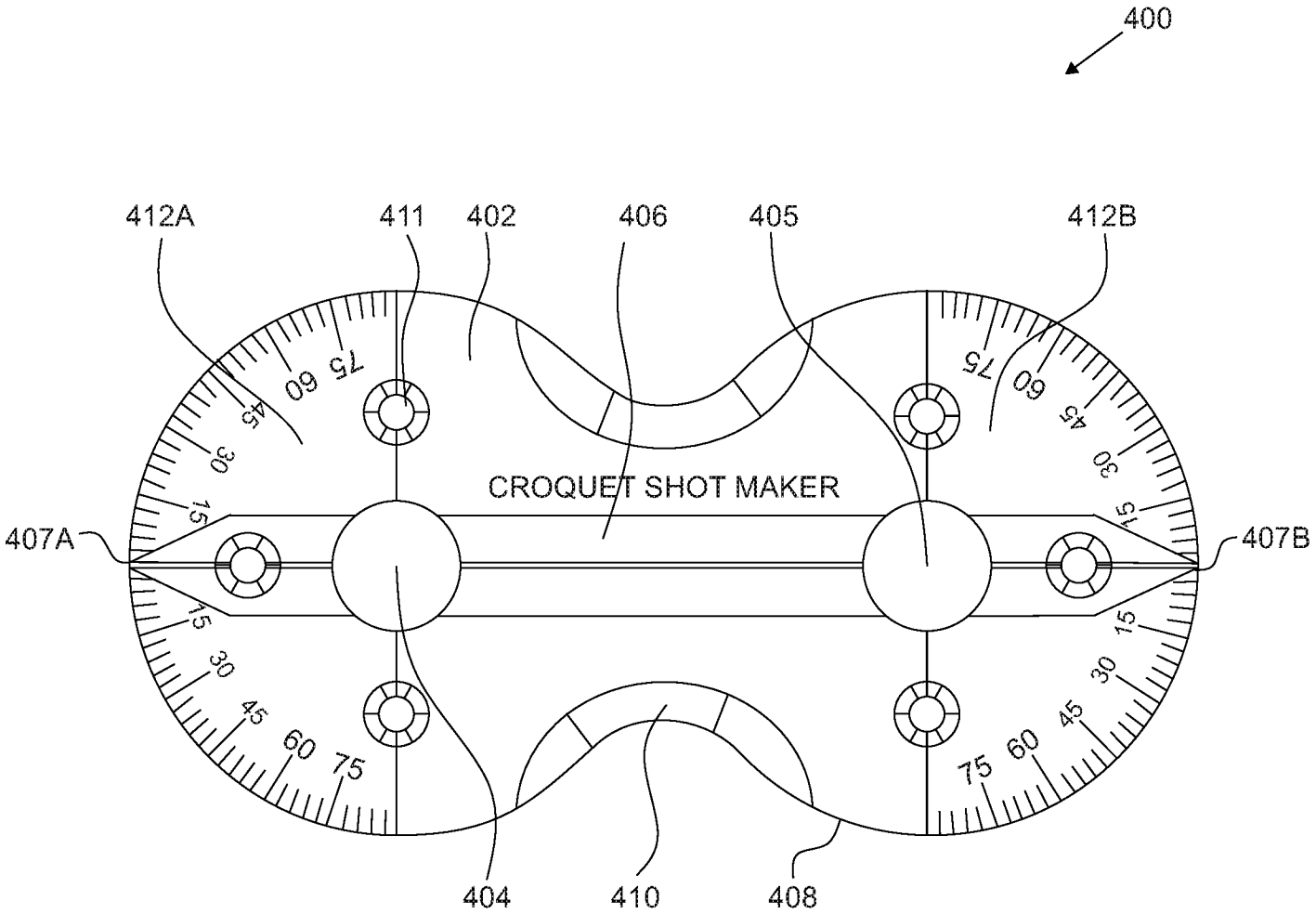
FIG. 4A illustrates a croquet shot maker according to one example of the technology.

FIG. 4A illustrates a croquet shot maker 400 according to one example of the technology. According to one example, the croquet shot maker 400 includes two disc-shaped bodies that are conjoined to form a figure eight-shaped body 402. According to one example, each of the two disc-shaped bodies are dimensioned to have a diameter that is substantially equal to the diameter of a ball used to play croquet. According to one example, holes 404,405 may be provided in the center of each of the two disc-shaped bodies and are dimensioned to receive balls therein. According to another example, instead of the holes 404,405, the croquet shot maker 400 may include indentations in the center of each of the two disc-shaped bodies to maintain the balls therein. According to one example, the centers of the holes 404,405 are spaced apart from each other a distance such that when the striker and croquet balls are placed over the holes 404,405, the two balls are provided in physical contact with each other. For example, the centers of the holes 404,405 may be spaced apart a distance that is substantially equal to a diameter of a ball.

According to one example, the croquet shot maker 400 may be engineered to accommodate for slight variations in ball sizes that may arise from factors such as manufacturing imperfections, expansion or contraction due to temperature, or expansion or contraction due to age, among other factors. For example, the centers of the holes 404,405 may be positioned slightly closer such as 1/32" closer to each other than a diameter of a ball. Alternatively, the holes 404,405 may be designed to apply the force of gravity to bring the balls together. For example, the holes 404,405 may include beveled or sloping edges or may otherwise be shaped to draw the balls toward each other. Still further, an area between or proximate to the holes 404,405 may be configured to apply the force of gravity to bring the balls together. For example, the area between or proximate the holes 404,405 may be sloped to draw the balls toward each other under the force of gravity. One of ordinary skill in the art will readily appreciate that other techniques, including a combination of techniques, may be applied to draw the balls placed in the croquet shot maker 400 in contact with each other such that movement of the balls after impact is not restricted.

According to one example, an aim marker 406 may be provided that spans across the croquet shot maker 400 in a lengthwise direction and extends through the centers of the holes 404, 405. The aim marker 406 may include first and second outwardly pointing arrows 407A, 407B, respectively, that point toward an edge 408 at opposite sides of the croquet shot maker 400. According to one example, the aim marker 406 may identify an aiming line for the croquet ball placed in one of the holes 404, 405. According to one example, the croquet shot maker 400 may be symmetric such that the croquet and striker balls may occupy either of the holes 404, 405 with equal effectiveness.

According to one example, each disc-shaped body that defines a boundary of the figure eight-shaped body may include angle markers positioned along the edge 408 in a half circle area 412A, 412B. For example, the first and second outwardly pointing arrows 407A, 407B may point to a 0° angle marker. According to one example, the angle markers may increment to 90° on both side of the first and second outwardly pointing arrows 407A, 407B such that in total the angle markers span 180° or a half circle. According to one example, a radial line extending through the angle markers will pass through a center of the corresponding circle. One of ordinary skill in the art will readily appreciate that the range of angles may be greater to or less than 180°.

According to one example, each disc-shaped body of the figure eight-shaped body is dimensioned such that its diameter is substantially equal to the diameter of a ball used to play croquet. According to one example, a player may select an angle marker along the edge 408 in the corresponding half circle area 412A, 412B in 2-D and may project the angle marker upward to a corresponding strike point along a circumference of the striker ball in 3-D. Alternatively, a player may select a strike point along a circumference of the striker ball in 3-D and may project the selected strike point downward onto the corresponding angle marker in the corresponding half circle area 412A, 412B to determine a 2-D representation of the strike point. A player may practice with the croquet shot maker 400 to quickly become a croquet shot expert through repeated exercises that include projecting between 2-D along the edge 408 in the corresponding half circle area 412A, 412B and 3-D along a circumference of the striker ball, and vice versa.

According to one example, the edge 408 may include a beveled or sloping surface 410 that allows a ball to roll on or off the croquet shot maker 400 without jumping, skidding, skipping, bouncing, or the like. While FIG. 4A illustrates the beveled or sloping surface 410 provided along only a portion of the edge 408, one of ordinary skill in the art will readily appreciate that the beveled or sloping surface 410 may be provided at any portion or all of the edge 408. According to one example, the holes 404, 405 may include a beveled or sloping edge along their perimeter to allow a ball to roll out of the holes 404, 405 without jumping, skidding, skipping, bouncing, or the like. According to one example, the croquet shot maker 400 may be placed flat on the ground and may include anchor holes 411 that allow the croquet shot maker 400 to be removably secured to the ground. For example, the croquet shot maker 400 may be fixedly secured to the ground using anchors such as push-in screws, pins, tees, bolts, or the like. According to one example, the anchor holes 411 may include beveled edges along their perimeters to allow the anchors to rest flush with an upper surface of the croquet shot maker 400.

With respect to employing the croquet shot maker 400 as a practice aid, it may be used for taking croquet in which a striker ball is placed in contact with a croquet ball during a croquet shot. In this case, a player may place the croquet shot maker 400 below the croquet and striker balls such that each ball rests over a corresponding hole 404, 405. According to one example, the first outwardly pointing arrow 407A may be aimed toward a desired direction that the croquet ball will follow when impacted by the striker ball. Once the croquet shot maker 400 is properly aimed toward the selected target, it may be secured in place using anchors pushed into the ground through the anchor holes 411. Alternatively, if the player is practicing on a hard surface, the anchors may be omitted.

Next, a player may select a direction and an angle to send the striker ball, relative to the selected target spot for the croquet ball, while preparing for the croquet shot. However, the striker ball may deviate from a path defined by the swinging mallet after impact. According to one example, a player may decide to send the striker ball at a 45° angle relative to the croquet ball. If the player projects the 45° angle marker from the croquet shot maker 400 upward to a corresponding strike point along a circumference of the striker ball in 3-D and swings the mallet at this 45° strike point, then the striker ball will likely travel at an approximately 90° angle relative to the croquet ball. As a rule of thumb, the striker ball will typically deviate at approximately twice the angle selected on the angle marker of the croquet shot maker 400. Thus, if a player desires to send the striker ball at a 45° angle relative to the croquet ball, then the player should project the 22.5° angle marker from the croquet shot maker 400 upward to a corresponding strike point along a circumference of the striker ball in 3-D. When the player swings the mallet at the approximately 22.5° strike point, the striker ball will travel at an approximately 45° angle relative to the croquet ball. The direction and angle may vary somewhat from a 2-to-1 ratio based on factor such as swing strength, mallet weight, or the like. Thus, the player may adjust from the 2-to-1 ratio to accommodate for specific circumstances.

Figure 11:
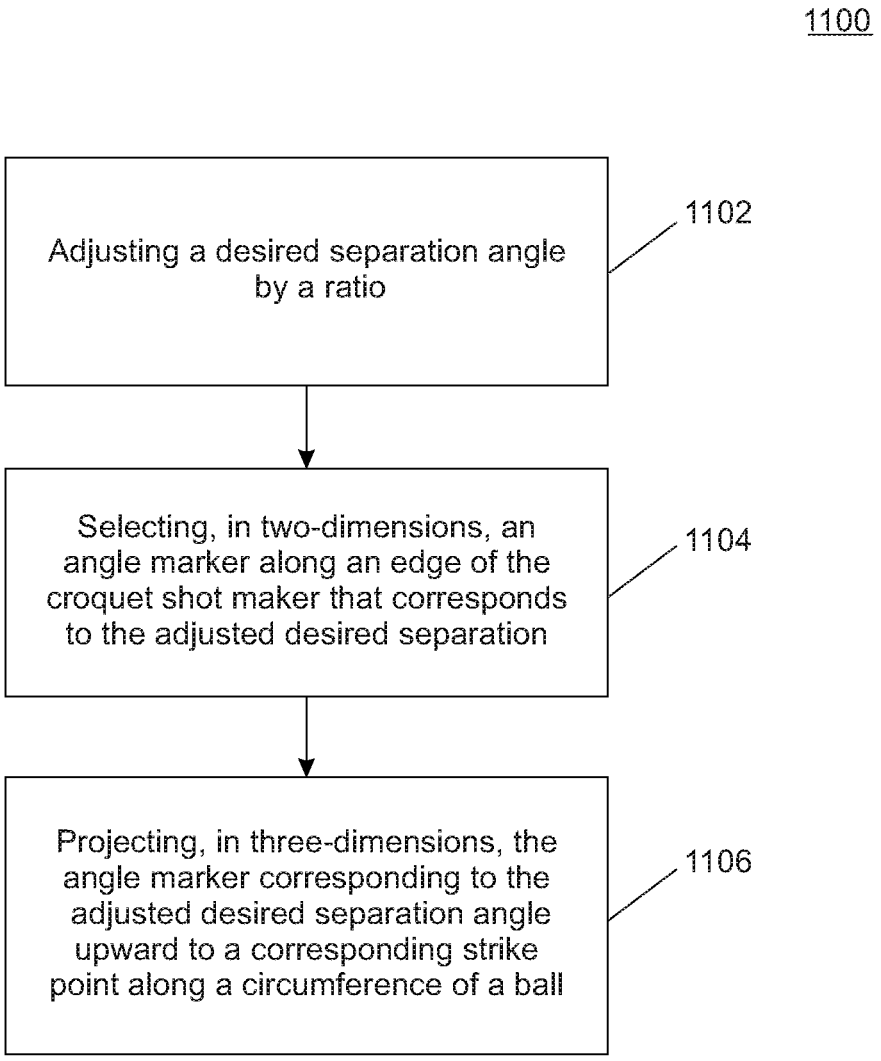
FIG. 11 illustrates a flowchart of an example method according to one example of the disclosure.

Returning to the example and with reference to FIG. 11, a method 1100 is provided for determining an adjusted desired separation angle. According to one example, the player may determine a desired separation angle between the striker and croquet balls after performing a croquet shot. In operation 1102, the player may adjust the desired separation angle by a ratio. For example, the player may divide the desired separation angle by a 2:1 ratio. In operation 1104, the player may select an angle marker along the edge 408 in the corresponding half circle area 412A, 412B in 2-D that corresponds to the adjusted desired separation angle. For example, if the desired separation angle is 45°, then the adjusted desired separation angle may be 22.5°. In operation 1106, the player may project the angle marker corresponding to the adjusted desired separation angle upward to a corresponding strike point along a circumference of the striker ball in 3-D. For example, if the player desires for the striker ball and the croquet ball to become separated by approximately 45° after impact, the player may select an angle marker along the edge 408 in the corresponding half circle area 412A, 412B in 2-D that corresponds to the adjusted desired separation angle of approximately 22.5°. The player may project the angle marker corresponding to approximately 22.5° upward onto a corresponding strike point along a circumference of the striker ball in 3-D. Accordingly, the technology allows a player to perform the strike point determination in 2-D using the croquet shot maker 400 rather than performing the strike point determination in 3-D on the striker ball. According to one example, the technology allows the player to use the angle markers along the edge 408 to determine a strike point that separates the balls by a desired angle in 2-D using the croquet shot maker 400.

According to one example, if the player desires to send the striker ball to a right side of the croquet ball after impact, the player may select the 22.5° angle marker provided on a left side of the corresponding first or second outwardly pointing arrows 407A, 407B. Otherwise, if the player desires to send the striker ball to a left side of the croquet ball after impact, the player may select the 22.5° angle marker provided on a right side of the corresponding first or second outwardly pointing arrows 407A, 407B. A similar process may be followed for any selected angle ranging from 0° to 90°.

Once the desired angle marker is selected, a corresponding strike point may be determined on the circumference of the striker ball. If desired, the mallet alignment tool 300 may be coupled to the croquet shot maker 400 such that the concave cutout 304 of the mallet alignment tool 300 is fitted to the circular edge 408 of the croquet shot maker 400 proximate to the striker ball. According to one example, a player may slide the mallet alignment tool 300 along the edge 408 until the arrow 308 is aligned with the selected angle marker. When properly coupled and aligned, a line extending through the arrow 308 of the mallet alignment tool 300 will pass through a center of the corresponding disc-shaped body of the croquet shot maker 400. Once the mallet alignment tool 300 is properly coupled and aligned, it may be secured in place using anchors pushed into the ground through the anchor holes 305. Alternatively, if the player is practicing on a hard surface, the anchors may be omitted.

According to one example, the swing trainer 100 may be coupled to the croquet shot maker 400 such that the concave cutout 104 of the swing trainer 100 is fitted to the circular edge 408 of the croquet shot maker 400 proximate to the striker ball. According to one example, a player may slide the swing trainer 100 along the edge 408 until the marker provided down a middle of the path 114 is aligned with the selected angle marker. When properly coupled and aligned, a line extending through the marker of the swing trainer 100 will pass through a center of the corresponding disc-shaped body of the croquet shot maker 400. Once the swing trainer 100 is properly coupled and aligned, it may be secured in place using anchors pushed into the ground through the anchor holes 116. Alternatively, if the player is practicing on a hard surface, the anchors may be omitted.

According to one example, after the corresponding strike point is determined on the circumference of the striker ball, a player may impact the strike point with the mallet head. According to one example, the striker ball should be impacted such that the mallet strikes into the center of the striker ball. According to one example, the player may self-guide the mallet to impact the strike point. Alternatively, the player may employ the mallet alignment tool 300 or the swing trainer 100 to guide the mallet to impact the strike point. In any case, the croquet ball will move off the croquet shot maker 400 in the direction of the corresponding first or second outwardly pointing arrows 407A, 407B. Separately, the striker ball will depart the croquet shot maker 400 at a particular angle. This angle can be approximated as being substantially twice the angle formed by the intersection of a line extending along path of the mallet and a second intersecting line extending through the centers of the two touching balls.

Figure 4B:
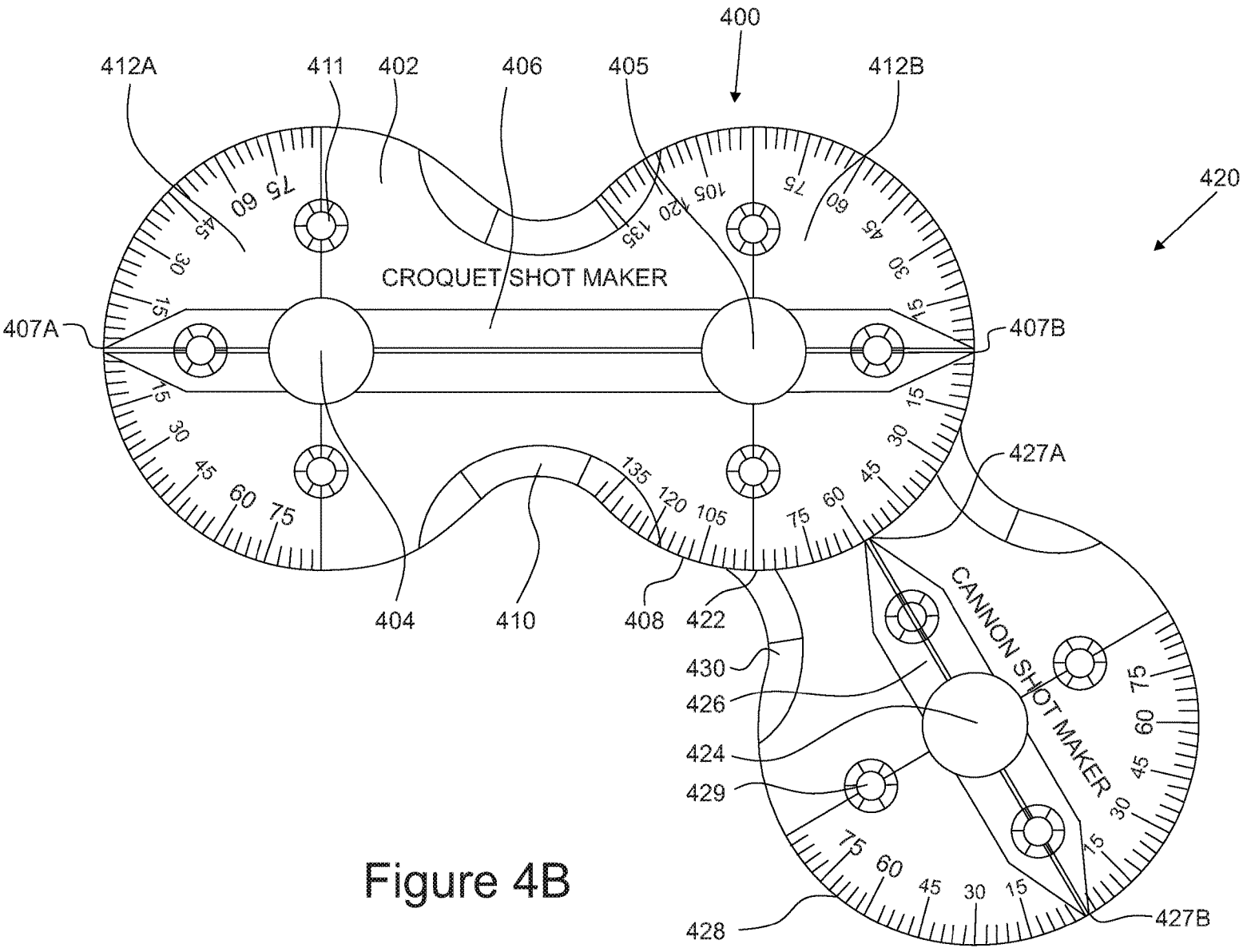
FIG. 4B illustrates a cannon shot maker provided alongside the croquet shot maker of FIG. 4A, according to one example of the technology.

FIG. 4B illustrates a cannon shot maker 420 according to one example of the technology. According to one example, the cannon shot maker 420 includes a disc-shaped body that is dimensioned to have a diameter that is substantially equal to the diameter of a ball used to play croquet. According to one example, the cannon shot maker 420 includes a mating portion with a concave cutout 422 that is integrally formed with the disc-shaped body. According to one example, the concave cutout 422 may be dimensioned to allow the cannon shot maker 420 to be coupled to the croquet shot maker 400. According to one example, an aperture or hole 424 may be provided in the center of the disc-shaped body and may be dimensioned to receive a ball thereon. According to another example, instead of the hole 424, the cannon shot maker 420 may include an indentation in the center of the disc-shaped body to maintain a ball thereon. According to one example, the center of the hole 424 is spaced apart from hole 405 of the the croquet shot maker 400 a distance such that when the croquet ball and the third ball are placed over the holes 405,424, the two balls are provided in physical contact with each other. For example, the centers of the holes 405,424 may be spaced apart a distance that is substantially equal to a diameter of a ball.

According to one example, a mechanism may be provided to fixedly secure the cannon shot maker 420 to the croquet shot maker 400. Alternatively, the cannon shot maker 420 may remain separate from the croquet shot maker 400. According to one example, the croquet shot maker 400 and the cannon shot maker 420 may be engineered to accommodate for slight variations in ball sizes that may arise from factors such as manufacturing imperfections, expansion or contraction due to temperature, or expansion or contraction due to age, among other factors. For example, the centers of the holes 405,424 may be positioned slightly closer such as 1/32" closer to each other than a diameter of a ball. Alternatively, the holes 405,424 may be designed to apply a force of gravity to bring the balls in contact. For example, the holes 405,424 may include beveled or sloping edges or may otherwise be shaped to draw the balls toward each other. Still further, an area between or proximate to the holes 405,424 may be configured to apply the force of gravity to bring the balls together. For example, the area between or proximate the holes 405,424 may be sloped to draw the balls toward each other under the force of gravity. One of ordinary skill in the art will readily appreciate that other techniques, including a combination of techniques, may be applied to draw the balls, placed in the croquet shot maker 400 and the cannon shot maker 420, in contact with each other such that movement of the balls after impact is not restricted.

According to one example, an aim marker 426 may be provided that spans the diameter of the cannon shot maker 420 and extends through a center of the hole 424. The aim marker 426 may include first and second outwardly pointing arrows 427A, 427B, respectively, that point toward an edge 428 at opposite sides of the cannon shot maker 420. According to one example, the aim marker 426 may identify an aiming line for the third ball placed in the hole 424. Furthermore, the outwardly pointing arrow 427A may identify an angle marker provided on the edge 408 in a half circle area 412A of the croquet shot maker 400. The angle markers may increment to 135° on both side of the second outwardly pointing arrow 407B of the croquet shot maker 400 such that in total the angle markers span 270° or three quarters of a circle. One of ordinary skill in the art will readily appreciate that the range of angles may be greater to or less than 270°.

According to one example, a player may slide the cannon shot maker 420 along the edge 408 of the croquet shot maker 400 until the outwardly pointing arrow 427A is aligned with the selected angle marker that is proximate to the croquet ball provided over the hole 405. The cannon shot maker 420 may be positioned relative to the croquet shot maker 400 such that a desired gap is provided between the striker ball positioned over the hole 404 and the third ball positioned over the hole 424. According to one example, the corresponding angle marker may be observed when the balls are separated by the desired gap. In this way, croquet players may learn to associate the desired gap between the striker ball and the third ball with a specific angle formed by the intersection of a first line, extending between the centers of the striker ball and the third ball, and a second line extending between the centers of the striker ball and the croquet ball. Conventionally, players estimated the desired gap between the striker ball and the third ball by placing coins of different diameters or another measuring device between the striker ball and the third ball. Conventional techniques are deficient at least because it is difficult to consistently replicate the desired gap. According to one example, the combination of the croquet shot maker 400 and the cannon shot maker 420 allow precise gap sizing that offer benefits such as immediate feedback and practice shot repeatability, among other benefits. According to one example, maintaining a constant and repeatable cannon shot set-up is invaluable in learning an effect of differing swing strength, striking angles, mallet weights, or the like, in cannon shots.

When properly coupled and aligned, a line extending through the outwardly pointing arrow 427A will pass through the center of the hole 405. According to one example, the cannon shot maker 420 may be placed flat on the ground and may include anchor holes 429 that allow the cannon shot maker 420 to be removably secured to the ground. For example, the cannon shot maker 420 may be fixedly secured to the ground using anchors such as push-in screws, pins, tees, bolts, or the like. According to one example, the anchor holes 429 may include beveled edges along their perimeters to allow the anchors to rest flush with an upper surface of the cannon shot maker 420. Once the cannon shot maker 420 is properly coupled and aligned, it may be secured in place using anchors pushed into the ground through the anchor holes 429. Alternatively, if the player is practicing on a hard surface, the anchors may be omitted.

According to one example, the edge 428 may include a beveled or sloping surface 430 that allows a ball to roll on or off the cannon shot maker 420 without jumping, skidding, skipping, bouncing, or the like. While FIG. 4B illustrates the beveled or sloping surface 430 along only a portion of the edge 428, one of ordinary skill in the art will readily appreciate that the beveled or sloping surface 430 may be provided along any portion or all of the edge 428. According to one example, the hole 424 may include a beveled or sloping edge along its perimeter to allow a ball to roll out of the hole 424 without jumping, skidding, skipping, bouncing, or the like.

With respect to employing the cannon shot maker 420 as a practice aid, it may be used for taking a cannon shot when a ball is rushed to a boundary and settles directly behind another ball such that two balls seek to occupy a same space. First, a croquet shot is set-up in which a striker ball is placed in contact with a croquet ball during a croquet shot. In this case, a player may place the croquet shot maker 400 below the croquet and striker balls such that each ball rests over a corresponding hole 404, 405. According to one example, the first outwardly pointing arrow 407A may be aimed toward a desired direction that the croquet ball will follow when impacted by the striker ball. Once the croquet shot maker 400 is properly aimed toward the selected target, it may be secured in place using anchors pushed into the ground through the anchor holes 411. Alternatively, if the player is practicing on a hard surface, the anchors may be omitted.

Next, a player may place a third ball in contact with the croquet ball such that a gap is provided between the third ball and the striker ball. The gap may be small or large at the option of the player. Similar to a croquet shot, the player may select a direction and an angle to send the striker ball relative to the selected target spot for the croquet ball while preparing for the croquet shot. However, the striker ball may deviate from a path defined by the swinging mallet after impact. According to one example, a player may decide to send the striker ball at a 45° angle relative to the croquet ball. If the player projects the 45° angle marker from the croquet shot maker 400 upward to a corresponding strike point along a circumference of the striker ball in 3-D and swings the mallet at this 45° strike point, then the striker ball will likely travel at an approximately 90° angle relative to the croquet ball. The direction and angle may vary somewhat from a 2-to-1 ratio discussed above based on factors such as swing strength, mallet weight, contact with the third ball, or the like. Thus, the player may adjust from the 2-to-1 ratio to accommodate for specific circumstances.

According to one example, if the player desires to send the third ball to a right side of the croquet ball after impact, the player may select an angle marker provided on a right side of the corresponding first or second outwardly pointing arrows 407A, 407B. Otherwise, if the player desires to send the third ball to a left side of the croquet ball after impact, the player may select the angle marker provided on a left side of the corresponding first or second outwardly pointing arrows 407A, 407B. In other words, the player should place the third ball on a side of the croquet ball that it should travel.

As discussed above, the mallet alignment tool 300 may be coupled to the croquet shot maker 400 such that the concave cutout 304 of the mallet alignment tool 300 is fitted to the circular edge 408 of the croquet shot maker 400 proximate to the striker ball. According to one example, a player may slide the mallet alignment tool 300 along the edge 408 proximate to the striker ball until the arrow 308 is aligned with the selected angle marker. When properly coupled and aligned, a line extending through the arrow 308 of the mallet alignment tool 300 will pass through a center of the corresponding disc-shaped body of the croquet shot maker 400. Once the mallet alignment tool 300 is properly coupled and aligned, it may be secured in place using anchors pushed into the ground through the anchor holes 305. Alternatively, if the player is practicing on a hard surface, the anchors may be omitted.

According to one example, the swing trainer 100 may be coupled to the croquet shot maker 400 such that the concave cutout 104 of the swing trainer 100 is fitted to the circular edge 408 of the croquet shot maker 400 proximate to the striker ball. According to one example, a player may slide the swing trainer 100 along the edge 408 proximate to the striker ball until the marker provided down a middle of the path 114 is aligned with the selected angle marker. When properly coupled and aligned, a line extending through the marker of the swing trainer 100 will pass through a center of the corresponding disc-shaped body of the croquet shot maker 400. Once the swing trainer 100 is properly coupled and aligned, it may be secured in place using anchors pushed into the ground through the anchor holes 116. Alternatively, if the player is practicing on a hard surface, the anchors may be omitted.

According to one example, after the corresponding strike point is determined on the circumference of the striker ball, a player may impact the strike point with the mallet head. According to one example, the striker ball should be impacted such that the mallet strikes into the center of the striker ball. According to one example, the player may self-guide the mallet to impact the strike point. Alternatively, the player may employ the mallet alignment tool 300 or the swing trainer 100 to guide the mallet to impact the strike point. In any case, the croquet ball will move off the croquet shot maker 400 in the direction of the corresponding first or second outwardly pointing arrows 407A, 407B. Separately, the striker ball will depart the croquet shot maker 400 at a particular angle and may strike the third ball. This angle may be approximated as being substantially twice the angle formed by the intersection of a line extending along path of the mallet and a second intersecting line extending through the centers of the two touching balls.

Figure 5:
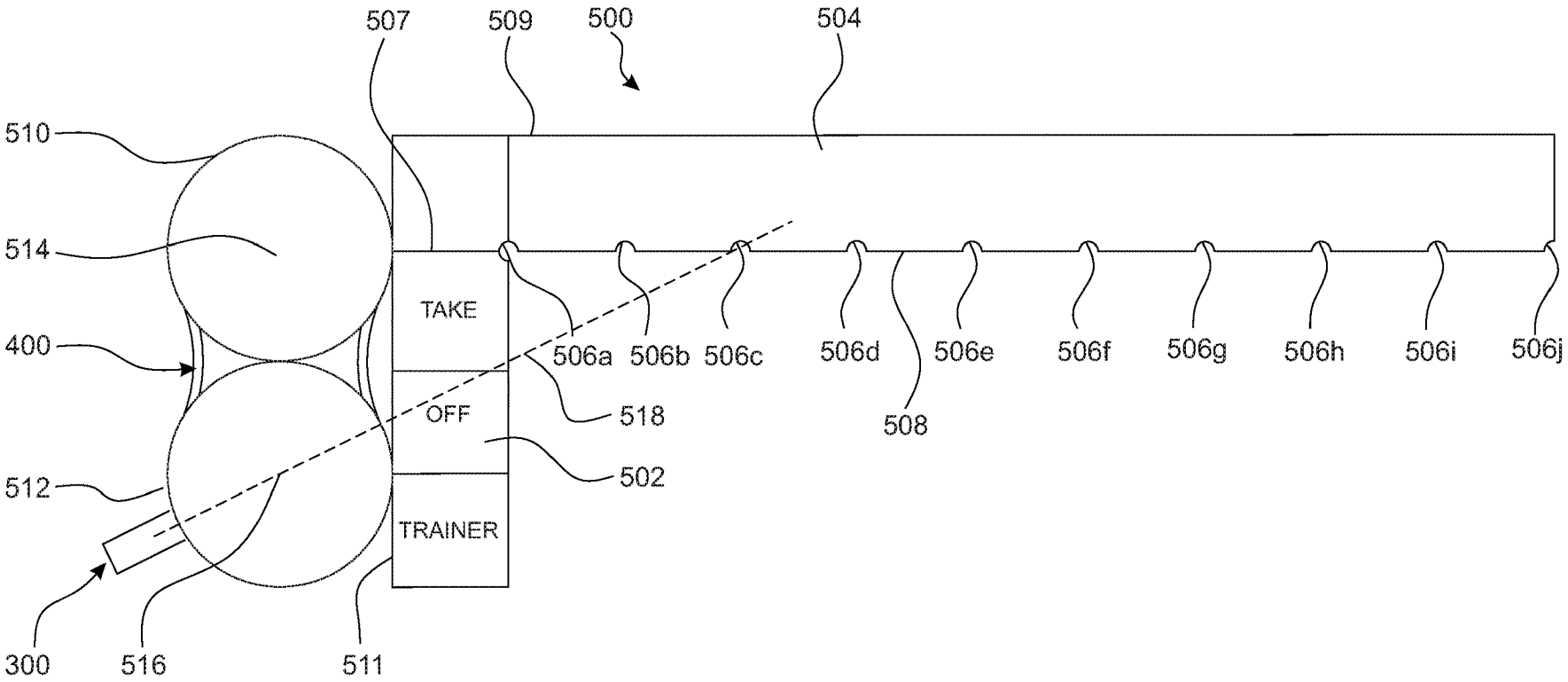
FIG. 5 illustrates a take-off trainer according to one example of the technology.

According to one example, a specific type of croquet shot in which the separation angle between the striker and croquet balls is approximate 90° is called a take-off shot. FIG. 5 illustrates a take-off trainer 500 according to one example of the technology that may be used with take-off shots. A separation angle of 90° may result when an angle formed by the intersection of a line extending along a path of the mallet head and a second line extending through the centers of the two touching balls reaches or exceeds 45°. For these types of croquet shots, a player may control relative distances travelled by the striker and croquet balls by varying the strike point on the striker ball to be above 45°, such as from 45° to 90°. For example, the striker ball may be impacted at a selected strike point such that the distance ratios after the take-off shot are approximately 1:1, 2:1, 4:1; 8:1, 16:1, 32:1, and so forth. As a point of comparison, croquet shots having a distance ratio of less than 1:1, such as shots with a 1:4 distance ratio, are considered standard croquet shots rather than take-off shots. As described above, the croquet shot maker 400 may be used for standard croquet shots in which the striker and croquet balls typically deviate by less than 90°.

With reference to FIG. 5, the take-off trainer 500 may include an "L"-shaped body that includes a short arm 502 that is substantially perpendicular to a long arm 504 according to one example of the technology. According to one example, the short arm 502 corresponds in length to a diameter of two balls used in croquet. According to one example, the long arm 504 may include aim markers 506*a*-506*j* provided along an inside edge 508 of the long arm 504. According to one example, the inside edge 508 is aligned with a segment 507. According to one example, the segment 507 may be spaced from an outside edge 509 of the long arm 504 by a length that corresponds to half a diameter of a croquet ball. According to one example, the aim markers 506*a*-506*j* may be separated from each other by a distance of substantially half a diameter of a ball used in croquet. According to one example, the aim markers 506*a*-506*j* may be defined by an indentation such that a nail, golf tee, pin, or the like, may be placed therein. According to one example, a first aim marker 506*a* is positioned at a location that is half a diameter of a croquet ball away from an outside edge 511 of the short arm 502. According to one example, the short arm 502 or the long arm 504 may have a width that corresponds to substantially half a diameter of a ball used in croquet.

With respect to employing the take-off trainer 500 as a practice aid, it may be used to practice take-off shots where the value of the angle marker on the croquet shot maker 400 is selected between 45°-90°. In this way, the take-off trainer 500 may be used in association with the croquet shot maker 400. FIG. 5 illustrates the take-off trainer 500 positioned proximate to a croquet ball 510 and a striker ball 512 that are placed on the croquet shot maker 400. According to one example, the take-off trainer 500 may be made to abut the edge 408 of the croquet shot maker 400 such that the inside edge 508 of the take-off trainer 500 is provided in-line with a center 514 of the croquet ball 510. In this way, the aim marker 506*a* may be positioned a pre-determined distance away from the center 514 of the croquet ball 510. According to one example, the pre-determined distance may correspond to substantially a diameter of the croquet ball 510. Each subsequent aim marker 506*b*-506*j* may be positioned a pre-determined distance away from the preceding marker such as substantially a half diameter of the croquet ball 510. According to one example, the aim marker 506*a* may correspond to a 1:1 distance ratio between the striker ball and the croquet ball; the aim marker 506*b* may correspond to a 2:1 distance ratio between the striker ball and the croquet ball; the aim marker 506*c* may correspond to a 4:1 distance ratio between the striker ball and the croquet ball; the aim marker 506*d* may correspond to an 8:1 distance ratio between the striker ball and the croquet ball; the aim marker 506*e* may correspond to a 16:1 distance ratio between the striker ball and the croquet ball; and so forth.

According to one example, a player may select a desired ratio such as a 4:1 ratio and may mark the spot corresponding to the aim marker 506*c* before removing the the take-off trainer 500. With reference to FIG. 5, a player may aim the mallet face simultaneously through a center 516 of the striker ball 512 and through the spot corresponding to the selected aim marker 506*c* as depicted by dashed line 518 in order to achieve the desired 4:1 ratio.

Once the desired angle marker is selected, a corresponding strike point may be determined on the circumference of the striker ball 512. If desired, the mallet alignment tool 300 may be coupled to the croquet shot maker 400 such that the concave cutout 304 of the mallet alignment tool 300 is fitted to the circular edge 408 of the croquet shot maker 400 proximate to the striker ball 512. According to one example, a player may slide the mallet alignment tool 300 along the edge 408 until the arrow 308 is aligned with the selected angle marker. When properly coupled and aligned, a line extending through the arrow 308 of the mallet alignment tool 300 will pass through a center of the striker ball 516. Once the mallet alignment tool 300 is properly coupled and aligned, it may be secured in place using anchors pushed into the ground through the anchor holes 305. Alternatively, if the player is practicing on a hard surface, the anchors may be omitted.

According to one example, the swing trainer 100 may be coupled to the croquet shot maker 400 such that the concave cutout 104 of the swing trainer 100 is fitted to the circular edge 408 of the croquet shot maker 400 proximate to the striker ball 512. According to one example, a player may slide the swing trainer 100 along the edge 408 until the marker provided down a middle of the path 114 is aligned with the selected angle marker. When properly coupled and aligned, a line extending through the marker of the swing trainer 100 will pass through the center of the striker ball 516. Once the swing trainer 100 is properly coupled and aligned, it may be secured in place using anchors pushed into the ground through the anchor holes 116. Alternatively, if the player is practicing on a hard surface, the anchors may be omitted.

According to one example, after the corresponding strike point is determined on the circumference of the striker ball 512, a player may impact the strike point with the mallet head. According to one example, the striker ball 512 should be impacted such that the mallet strikes through the center 516 of the striker ball 512. According to one example, the player may self-guide the mallet to impact the strike point. Alternatively, the player may employ the mallet alignment tool 300 or the swing trainer 100 to guide the mallet to impact the strike point. In any case, the croquet ball will move off the croquet shot maker 400 in the direction of the corresponding first or second outwardly pointing arrows 407A, 407B. Separately, the striker ball will depart the croquet shot maker 400 at an angle that is larger than an angle formed by the intersection of a line extending along path of the mallet and a second line extending through the centers of the two touching balls. However, in the configuration illustrated in FIG. 5, if a take-off shot is attempted with the take-off trainer 500 in place, the striker ball 512 will travel over the short arm 502 of the take-off trainer 500. This interaction between the striker ball 512 and the short arm 502 may cause inconsistent results. One way to overcome this is to identify an aim point along the long arm 504 and place a nail, golf tee, or the like into the ground at the corresponding aim marker 506*a*-506*j*. Next, the take off trainer 500 may be removed and the take-off shot may be attempted. According to one example, the aim markers 506*a*-506*j* along the long arm 504 of the take-off trainer 500 may include circular cutouts designed to facilitate placement of a nail, golf tee, or the like, therein. One of ordinary skill in the art will readily appreciate that the aim markers 506*a*-506*j* along the long arm 504 of the take-off trainer 500 may include any shape cutouts.

Figure 6:
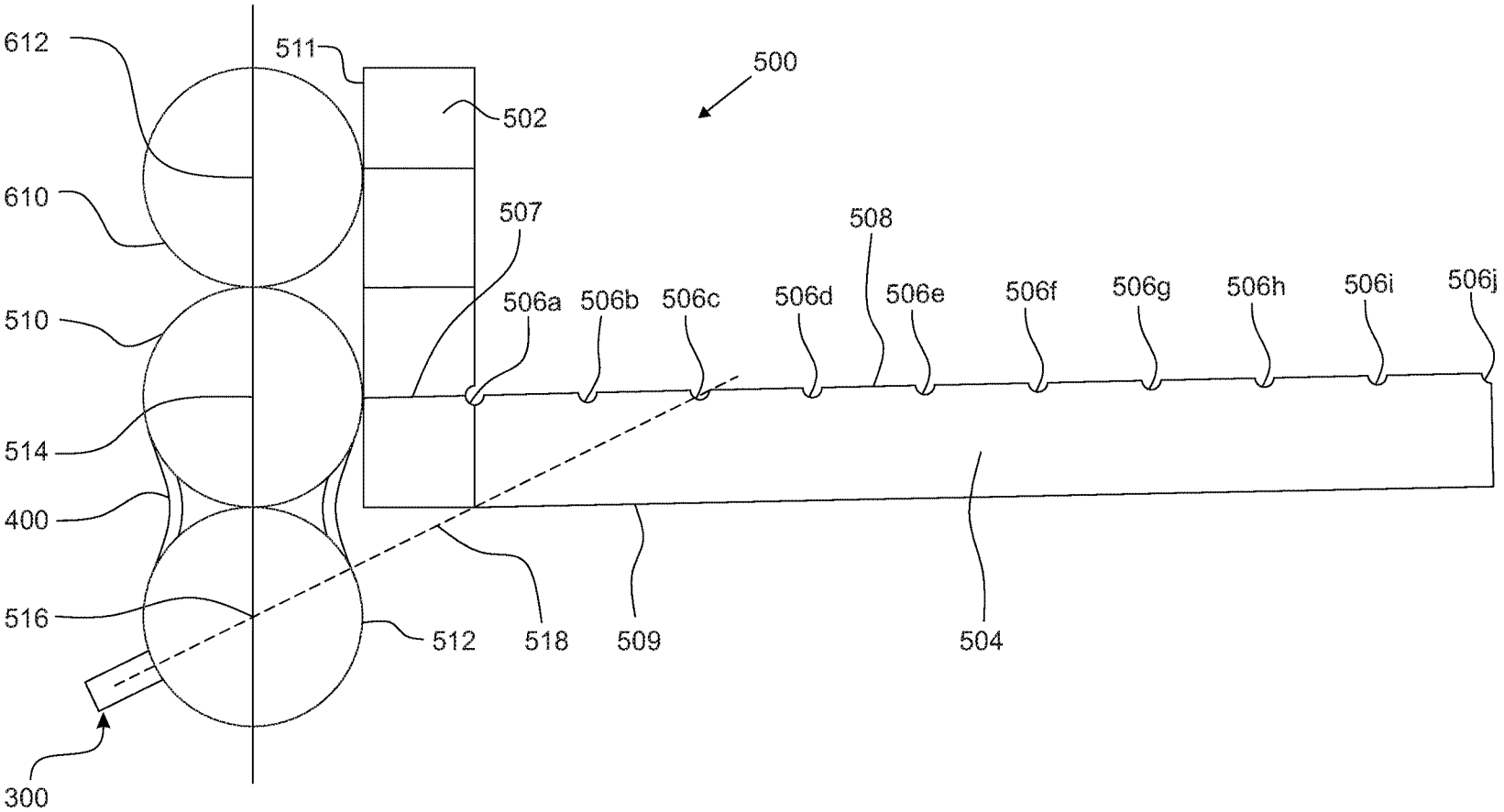
FIG. 6 illustrates an alternative arrangement for the take-off trainer according to one example of the technology.

FIG. 6 illustrates another arrangement for the take-off trainer 500 according to one example of the technology that offers an alternative to prevent the striker ball 512 from traveling over the short arm 502 of the take-off trainer 500 after impact. FIG. 6 illustrates a third ball 610 that allows the take-off trainer 500 to remain positioned when the striker ball 512 is impacted. According to one example, the take-off trainer 500 may be flipped as compared to the arrangement in FIG. 5 such that the short arm 502 points in an opposite direction. According to one example, the third ball 610 is provided on an opposite side of the croquet ball 510. Accordingly, the striker ball 512 is placed on a first side of the croquet ball 510 and the third ball 610 is placed on a second side of the croquet ball 510 such that all three balls 510, 512, 610 are in contact such that the centers of all three balls form a single straight line. As illustrated in FIG. 6, the take-off trainer 500 may be provided to abut against the croquet ball 510 and the third ball 610. Otherwise, the above-described features of the take-off trainer 500 remain unchanged. Once the take-off trainer 500 is properly aligned, it may be secured in place using anchors pushed into the ground through the anchor holes. Alternatively, if the player is practicing on a hard surface, the anchors may be omitted. One of ordinary skill in the art will readily appreciate that the posotops of the aim markers 506*a*-506*j* remain constant between FIGS. 5 and 6.

Figure 7:
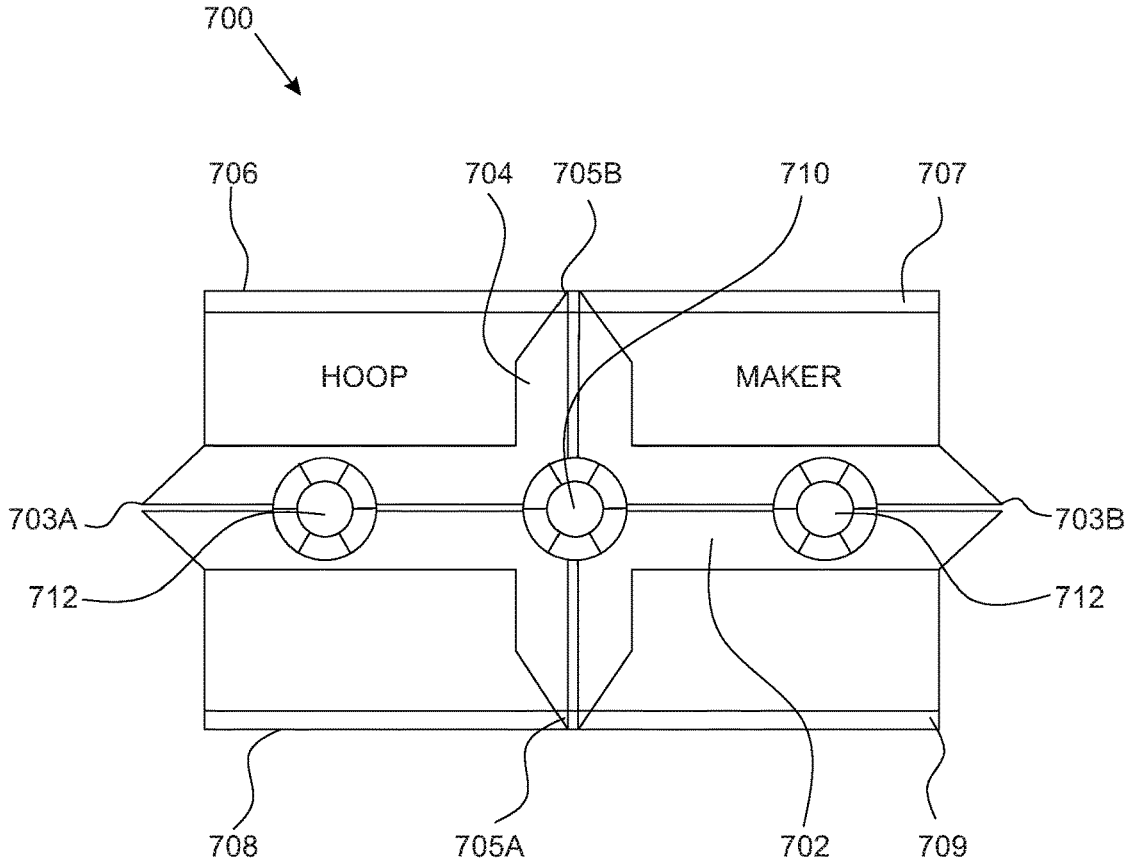
FIG. 7 illustrates a hoop maker according to one example of the technology.

FIG. 7 illustrates a hoop maker 700 according to one example of the technology. According to one example, the hoop maker 700 may include a body having a substantially rectangular shape and an orientation marker 702 that extends along the longer dimension. According to one example, the orientation marker 702 may include outwardly pointing arrows 703A, 703B. According to one example, the tips of the outwardly pointing arrows 703A, 703B may be dimensioned to fit between the wires of a hoop. In other words, the tips of the outwardly pointing arrows 703A, 703B may be separated by a length that is substantially equivalent to a diameter of a ball used to play croquet. As a point of comparison, the wires of the hoop are typically spaced apart such that they are ⅛" or 1/64" wider than the diameter of a ball used to play croquet. According to one example, the hoop maker 700 may include an aim marker 704 that extends along the shorter dimension. According to one example, the aim marker 704 may include outwardly pointing arrows 705A, 705B. According to one example, the tips of the outwardly pointing arrows 705A, 705B may be separated by a length that is substantially equal to a half diameter of a ball used to play croquet. One of ordinary skill in the art will readily appreciate that the hoop maker 700 may be constructed from other shapes and may include different dimensions.

According to one example, the hoop maker 700 may include edges 706, 708 that may include a beveled or sloping surface 707,709 that allows a ball to roll on or off the hoop maker 700 without jumping, skidding, skipping, bouncing, or the like. According to one example, the hoop maker 700 may include an aperture or hole 710 that may be positioned at an intersection between the orientation marker 702 and the aim marker 704. In this position, the hole 710 is provided mid-way between the wires of the hoop and directly under the hoop. In this way, the hoop maker 700 may be used from both sides of the hoop. The hole 710 may include a beveled or sloping edge along its perimeter. According to one example, the hoop maker 700 may be placed flat on the ground below and between the wires of the hoop and may include anchor holes 712 that allow the hoop maker 700 to be removably secured to the ground. For example, the hoop maker 700 may be fixedly secured to the ground using anchors such as push-in screws, pins, tees, bolts, or the like.

According to one example, the anchor holes 712 may include beveled edges along their perimeters to allow the anchors to rest flush with an upper surface of the hoop maker 700.

A player shoots the ball through hoops while navigating around a croquet court during a game. With respect to employing the hoop maker 700 as a practice aid, it may be placed between the wires of the hoop to identify an aim point and an approach path to the aim point that will increase the probability a ball will pass through the hoop. As a starting point, the hoop maker 700 is placed within the hoop such that the tips of the outwardly pointing arrows 703A, 703B are positioned proximate with the wires of the hoop and the orientation marker 702 is provided directly under a top portion of the hoop. Once the hoop maker 700 is properly oriented within the hoop, a rotation anchor may be pushed into the ground through the hole 710. In this way, the hoop maker 700 may be permitted to rotate about an axis that extends through the hole 710 in a direction substantially perpendicular to the ground. Alternatively, if the player is practicing on a hard surface, the rotation anchor may be omitted.

According to one example, the aim point corresponds to the hole 710 and the approach path to the aim point is determined by visually extending a line defined by the aim marker 704. According to one example, the hoop maker 700 may be rotated about the hole 710 such that the corresponding outwardly pointing arrow 705A, 705B is aimed toward the ball that will be hit through the hoop. According to one example, the hoop maker 700 may be maintained in the initial set-up position for a straight hoop shot. According to another example, the hoop maker 700 may be rotated from the initial position for an angled hoop shot. The aim point will remain stationary regardless of the rotation angle of the hoop maker 700. Once the corresponding outwardly pointing arrow 705A, 705B is aimed toward the ball that will be hit through the hoop, anchors may be pushed into the ground through the anchor holes 712. Alternatively, if the player is practicing on a hard surface, the anchors may be omitted.

According to one example, the single ball shot trainer 200 may be used in association with the hoop maker 700. In this arrangement, the single ball shot trainer 200 may be placed under the croquet ball and the first outwardly pointing arrow 207A may be aimed toward the hoop maker 700. For example, the first outwardly pointing arrow 207A of the single ball shot trainer 200 may be aimed toward the corresponding outwardly pointing arrow 705A, 705B of the hoop maker 700. More particularly, the first outwardly pointing arrow 207A of the single ball shot trainer 200 may be aimed such that a line extending therefrom passes over both the hole 710 and the tip of the corresponding outwardly pointing arrow 705A, 705B of the hoop maker 700. With this aiming technique, the center of the croquet ball will pass over the hole 710 of the hoop maker 700, which is positioned in the middle of the hoop. Once the single ball shot trainer 200 is properly aimed toward the selected target, it may be secured in place using anchors pushed into the ground through the anchor holes 210. Alternatively, if the player is practicing on a hard surface, anchors may be omitted. According to one example, the strike point 214 may be projected upward onto the circumference of the croquet ball that rests on the hole 204 to determine an impact point. A player may hit the impact point on the croquet ball to cause it to pass through the hoop.

According to one example, the swing trainer 100 may be used in association with the single ball shot trainer 200 such that the concave cutout 106 of the swing trainer 100 is fitted to the circular edge 202 of the single ball shot trainer 200. According to one example, a player may slide the swing trainer 100 along the edge 202 until the marker, which is provided down a middle of the path 114, is aligned with the second outwardly pointing arrow 207B of the single ball shot trainer 200. When properly coupled and aligned, a line extending through the marker of the swing trainer 100 will pass through a center of the single ball shot trainer 200. According to one example, a chalk line may be snapped along the ground between the first outwardly pointing arrow 207A of the single ball shot trainer 200 and the corresponding outwardly pointing arrow 705A, 705B of the hoop maker 700 to provide a guide line for the striker ball. Once the swing trainer 100 is properly coupled and aligned, it may be secured in place using anchors pushed into the ground through the anchor holes 116. Alternatively, if the player is practicing on a hard surface, the anchors may be omitted.

Figure 8:
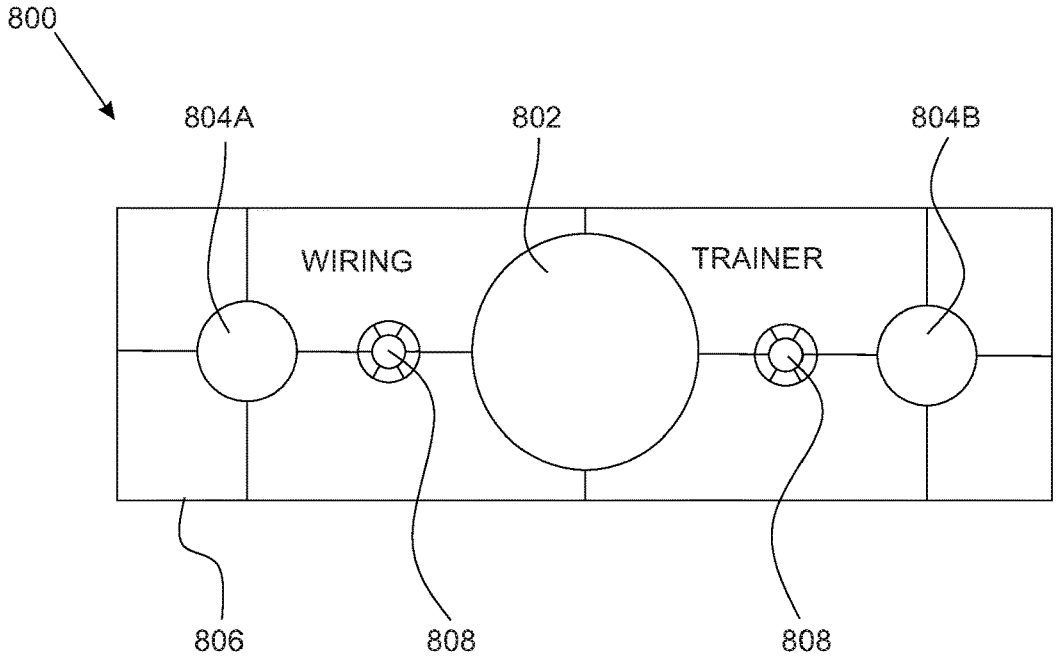
FIG. 8 illustrates a wiring trainer according to one example of the technology.

FIG. 8 illustrates a wiring trainer 800 according to one example of the technology. According to one example, the wiring trainer 800 may include a body having a substantially rectangular shape and may include a plurality of holes that extend along the longer dimension. According to one example, the wiring trainer 800 may mimic either a peg or a hoop. According to one example, an aperture or hole 802 may be provided in the center of the wiring trainer 800. The hole 802 may include a diameter that is substantially equal to a diameter of a peg. According to another example, outer apertures or holes 804A, 804B may be provided proximate to the short sides of the wiring trainer 800. According to one example, the outer holes 804A, 804B may be separated from each other by the width of a hoop. Furthermore, the outer holes 804A, 804B may each have a diameter that is substantially equal to a diameter of a hoop post.

According to one example, the wiring trainer 800 may include an edge 806 having a beveled or sloping surface that allows a ball to roll on or off the wiring trainer 800 without jumping, skidding, skipping, bouncing, or the like. According to one example, the wiring trainer 800 may be placed flat on the ground and may include anchor holes 808 that allow the wiring trainer 800 to be removably secured to the ground. For example, the wiring trainer 800 may be fixedly secured to the ground using anchors such as push-in screws, pins, tees, bolts, or the like. According to one example, the anchor holes 808 may include beveled edges along their perimeters to allow the anchors to rest flush with an upper surface of the wiring trainer 800. Alternatively, if the player is practicing on a hard surface, the anchors may be omitted.

According to one example, the wiring trainer 800 may be placed anywhere on a lawn or carpet to practice wiring, which is the art of positioning or "leaving" an opponent's ball near a peg or a hoop such that the ball is blocked. According to one example, the wiring trainer 800 may be used in association with the swing trainer 100, the single ball shot maker 200, the mallet alignment tool 300, or the croquet shot maker 400.

According to one example, the above described practice aids may be used to improve scoring during a croquet game. For example, the above described practice aids may be used to improve peeling. According to one example, the single ball shot trainer 200 may be used with the striker ball or the object ball to set up and execute a rush peel. According to one example, the swing trainer 100 or the hoop maker 700 may be used with the single ball shot trainer 200 as described above to set up and execute a rush peel. According to another example, the single ball shot trainer 200 may be used with a second single ball shot trainer 200 to set up and execute the rush peel using both the striker and the object balls. According to one example, the swing trainer 100 or the hoop maker 700 may be used with the corresponding single ball shot trainer 200 or the second single ball shot trainer 200 as described above to set up and execute the rush peel.

According to one example, the croquet shot maker 400 may be used as described above to set up and train players on how to execute peels that are accomplished with croquet shots. Alternatively, the croquet shot maker 400 may be used as described above with the mallet alignment tool 300, the swing trainer 100, or the hoop maker 700 to set up and train players on how to execute peels that are accomplished with croquet shots. According to yet another example, the croquet shot maker 400, the take-off trainer 500, the mallet alignment tool 300, or the swing trainer 100 may be used as described above to organize and practice a take-off peel.

Figure 9A:
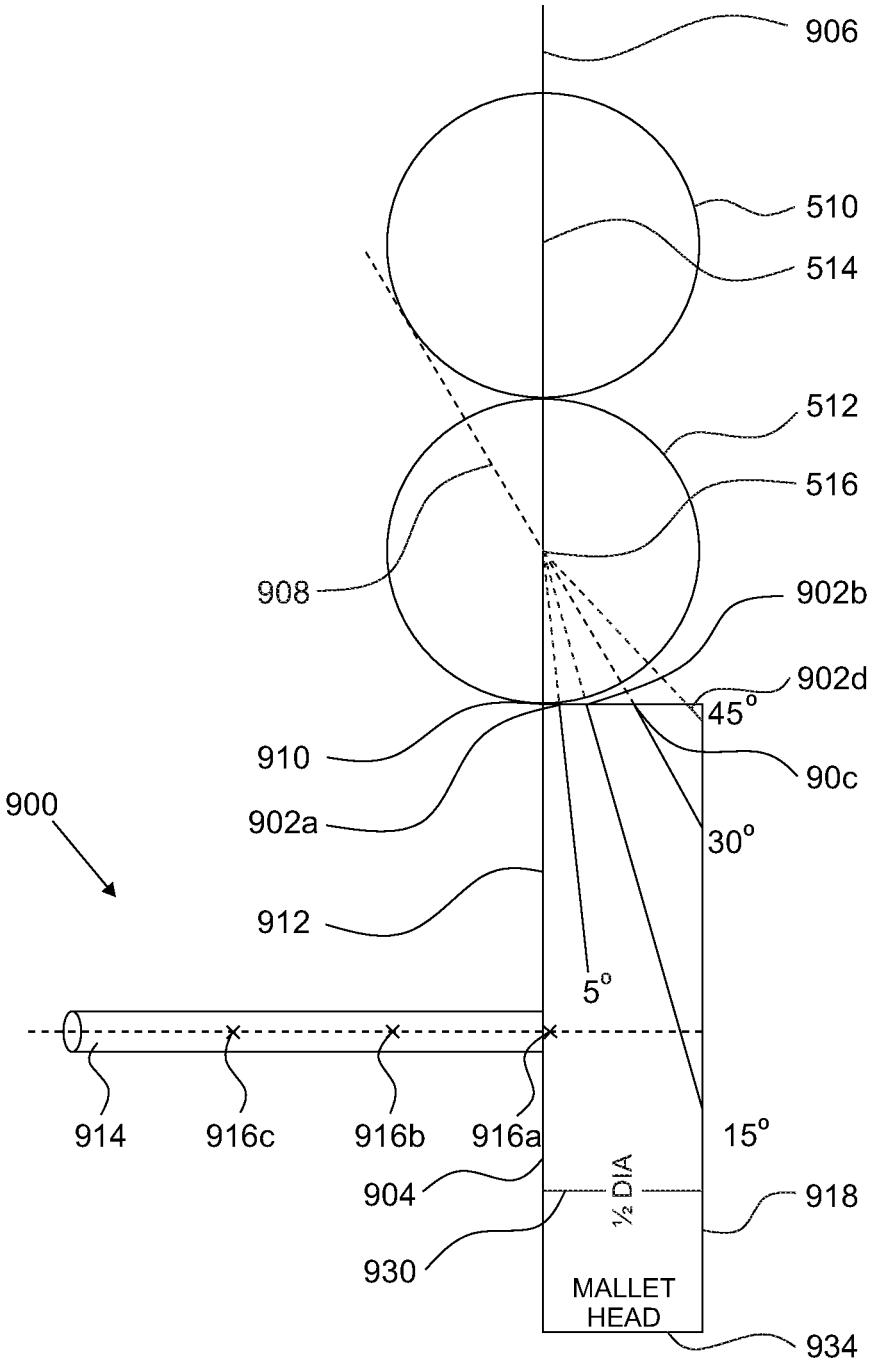
FIG. 9A illustrates a mallet positioned behind a croquet shot such that a first side of the mallet head faces upwards.

FIG. 9A illustrates a first side of the mallet 900 that includes on-mallet playing aids according to one example of the technology. According to one example, the mallet 900 may include a plurality of angle markers 902*a*-902*d* provided along a front edge on a first side of a mallet head 904. According to one example, the angle markers 902*a*-902*d* may be provided on a side face of the mallet head 904. For example, the angle markers 902*a*-902*d* may be printed, etched, or the like, on a side face of the mallet head 904. According to one example, the angle markers 902*a*-902*d* may be provided directly or indirectly on a side face of the mallet head 904. For example, the angle markers 902*a*-902*d* may be printed on a substrate that is affixed to the mallet head 904 using adhesive, epoxy, a magnet, or the like. According to one example, the substrate may be made from plastic, waxed paper, metal, wood, or the like. Alternatively, the angle markers 902*a*-902*d* may be printed on a substrate that forms the mallet head 904. For example, the substrate may include carbon fiber, metal, wood, or other material used to manufacture the mallet head 904. Furthermore, the substrate may include any coating that is applied to the mallet head 904. According to one example, the substrate may be dimensioned to correspond to dimensions of one or more side faces of the mallet head 904. For example, the substrate may be cut to fit the dimensions of side faces of the mallet head 904. According to one example, the substrate may be aligned prior to being affixed to the mallet head 904. Alternatively, the angle markers 902*a*-902*d* may be applied to the substrate during the process of manufacturing the mallet 900. According to one example, the angle markers 902*a*-902*d* may include lines that extend along a length of the mallet head 904 to facilitate alignment of the mallet head 904 with the croquet and striker balls 510, 512. One of ordinary skill in the art will readily appreciate that the angle markers 902*a*-902*d* may be depicted in other ways that facilitate alignment between the mallet head 904, the croquet ball 510, and the striker ball 512. According to one example, the mallet head 904 may include angled notches along the front edge at the mallet face.

With reference to FIG. 9A and according to one example, the angle markers 902*a*-902*d* may correspond to 5°, 15°, 30°, and 45°, respectively. As depicted by the dashed lines extending from each of the angle markers 902*a*-902*d*, the angle markers 902*a*-902*d* may originate from the center 516 of the striker ball 512. One of ordinary skill in the art will readily appreciate that any angle originating from the center 516 of the striker ball 512 may be represented on the mallet head 904. According to one example, since players tend to divide a striker ball angle in half to obtain a starting point for a mallet angle, the angle markers may include a sequence of angles where each angle is half the preceding angle such as 45°, 22.5°, 11.25°, 5.625°, 2.8125°, and 1.40625°. Alternatively or additionally, the angle markers may include a sequence of angles such as 30°, 15°, 7.5°, 3.75°, 1.875°, and 0.9375°. According to one example, each sequence of angle markers may be depicted using a different color in order to facilitate identification of different angle sequences. According to one example, the angle markers allow a player to identify a desired striker-ball angle and simply move down one angle of a particular color to determine a starting point of the mallet angle. As a general rule, the striker ball may deviate from a path defined by the swinging mallet at an approximately 2-to-1 ratio. If a player decides to send the striker ball at a 45° angle, the player should swing the mallet approximately at the 22.5° strike point.

FIG. 9A further illustrates two balls positioned for taking croquet with the striker ball 512 placed in contact with the croquet ball 510. According to one example, a line 906 is illustrated that extends through a center 514 of the croquet ball 510 and the center 516 of the striker ball 512. The mallet 900 is positioned with the mallet face proximate to the striker ball 512 such that an upper surface 912 of the mallet head 904 is aligned with the line 906. In this arrangement, a dashed line 908 that extends from the angle marker 902*c*, which represents 30°, passes through the center 516 of the striker ball 512 and is tangent to the croquet ball 510. If the upper surface 912 of the mallet head 904 is not aligned with the line 906, then the misalignment may be detected because the dashed line 908 will not extend through the center 516 of the striker ball 512 or will not be tangent to the croquet ball 510.

According to one example, the angle markers 902*a*-902*d* provided on the mallet head 904 perform a similar function to the angle markers of the croquet shot maker 400 positioned along the edge 408 of the half circle area 412A, 412B. More specifically, the angle markers 902*a*-902*d* correspond to the angle markers provided on a right side of the first and second outwardly pointing arrows 407A, 407B when facing inwardly against the the arrows 407A, 407B. In this instance, the striker ball 512 will deviate to the left of the croquet ball 510 after the croquet shot. With reference to FIG. 9A, a corner 910 of the mallet head 904 corresponds to a 0° angle marker and the opposite corner on the front face of the mallet head 904 is proximate to the 45° angle marker 902*d*.

Figure 10:
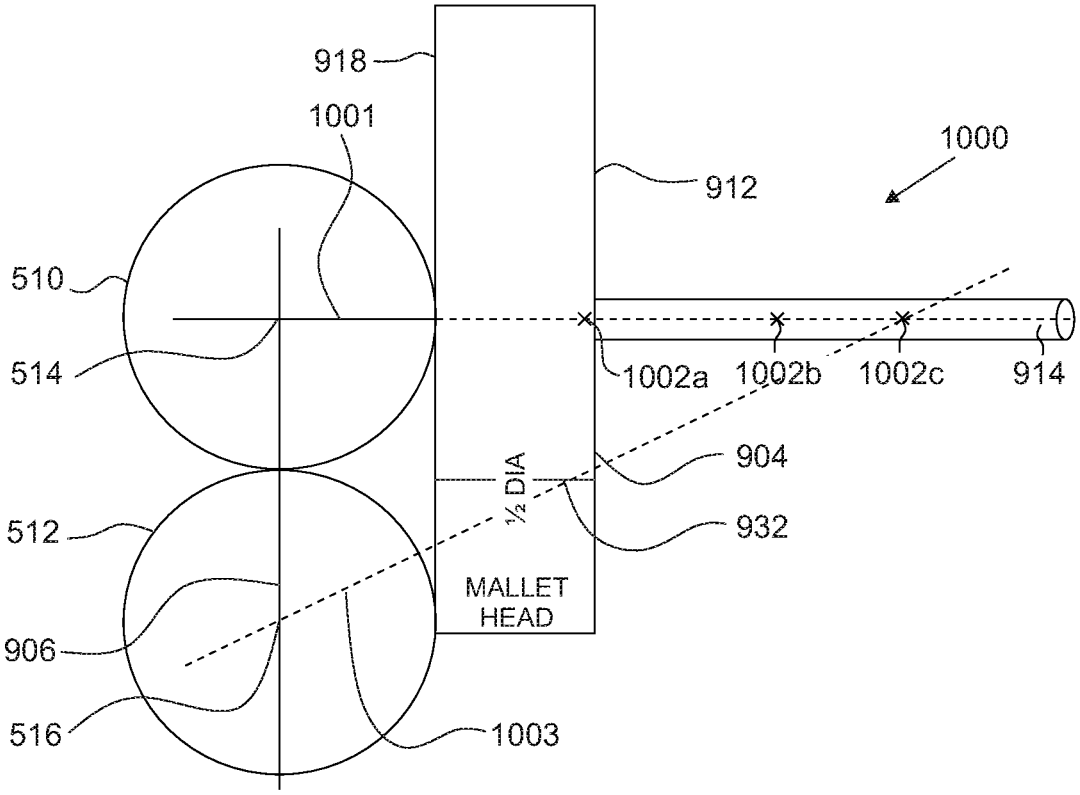
FIG. 10 illustrates a mallet arranged to set-up a take-off shot with the second side of the mallet head facing upwards.

FIG. 10 illustrates two balls positioned for taking croquet with the striker ball 512 placed in contact with the croquet ball 510. According to one example, a line 906 is illustrated that extends through a center 514 of the croquet ball 510 and the center 516 of the striker ball 512. According to one example, the mallet 1000 includes a lower surface 918 on the mallet head 904 that is positioned to abut the croquet ball 510 and a striker ball 512 such that the mallet shaft 914 is provided in-line with a center 514 of the croquet ball 510 as demonstrated by line 1001. According to another example, the mallet head 904 and mallet shaft 914 may include aim markers 1002*a*-1002*c* that perform a similar function to the aim markers 506*a*-506*j* provided along the inside edge 508 of the take-off trainer 500. According to one example, the aim markers 1002*a*-1002*c* may be provided on a side face of the mallet head 904 and on the mallet shaft 914. For example, the aim markers 1002*a*-1002*c* may be printed, etched, or the like, on a side face of the mallet head 904 and on the mallet shaft 914. According to one example, the aim markers 1002*a*-1002*c* may be provided directly or indirectly on a side face of the mallet head 904 and on the mallet shaft 914. For example, the aim markers 1002*a*-1002*c* may be printed on a substrate that is affixed to the mallet head 904 and the mallet shaft 914 using adhesive, epoxy, a magnet, or the like. According to one example, the substrate may be made from plastic, waxed paper, metal, wood, or the like. Alternatively, the aim markers 1002*a*-1002*c* may be printed on a substrate that forms the mallet head 904 and the mallet shaft 914. For example, the substrate may include carbon fiber, graphite, metal, wood, or other material used to manufacture the mallet head 904 and the mallet shaft 914. Furthermore, the substrate may include any coating that is applied to the mallet head 904 and the mallet shaft 914. According to one example, the substrate may be dimensioned to correspond to dimensions of side faces of the mallet head 904 and/or dimensions of the mallet shaft 914. For example, the substrate may be cut to fit the dimensions of side faces of the mallet head 904 and the mallet shaft 914. According to one example, the substrate may be aligned prior to being affixed to the mallet head 904 and the mallet shaft 914. Alternatively, the aim markers 1002*a*-1002*c* may be applied to the substrate during the process of manufacturing the mallet 900.

According to one example, the aim markers 1002*a*-1002*c* may be separated from each other by a distance of substantially half a diameter of a ball used in croquet. According to one example, the aim marker 1002*a* may be positioned a pre-determined distance away from the center 514 of the croquet ball 510. According to one example, the pre-determined distance may correspond to substantially a diameter of the croquet ball 510. Each subsequent aim marker 1002*b*-1002*c* may be positioned a pre-determined distance of substantially a half diameter of the croquet ball 510 away from the preceding marker. According to one example, the aim marker 1002*a* may correspond to a 1:1 ratio, the aim marker 1002*b* may correspond to a 2:1 ratio, the aim marker 1002*c* may correspond to a 4:1 ratio, and so forth.

According to one example, a player may select a desired ratio such as a 4:1 ratio and may visualize a spot corresponding to the aim marker 1002*c* represented by dashed line 1003 before removing the mallet 1000. A player may aim the mallet face simultaneously through a center 516 of the striker ball 512 and through the visualized spot corresponding to the selected aim marker 1002*c* in order to achieve the desired 4:1 ratio.

Returning to FIG. 9A, the mallet head 904 and mallet shaft 914 may include aim markers 916*a*-916*c* that perform a similar function to the aim markers 506*a*-506*j* provided along the inside edge 508 of the take-off trainer 500. According to one example, the aim markers 916*a*-916*c* may be separated from each other by a distance of substantially half a diameter of a ball used in croquet. According to one example, a lower surface 918 of the mallet head 904 may be positioned to abut the croquet ball 510 and a striker ball 512 such that the mallet shaft 914 is provided in-line with a center 514 of the croquet ball 510. In this way, the aim marker 916*a* may be positioned a pre-determined distance away from the center 514 of the croquet ball 510. According to one example, the pre-determined distance may correspond to substantially a diameter of the croquet ball 510. Each subsequent aim marker 916*b*-916*c* may be positioned a pre-determined distance of substantially a half diameter of the croquet ball 510 away from the preceding marker. According to one example, the aim marker 916*a* may correspond to a 1:1 ratio, the aim marker 916*b* may correspond to a 2:1 ratio, the aim marker 916*c* may correspond to a 4:1 ratio, and so forth.

According to one example, a player may select a desired ratio such as a 4:1 ratio and may visualize a spot corresponding to the aim marker 916*c* before removing the mallet 900. A player may aim the mallet face simultaneously through a center 516 of the striker ball 512 and through the visualized spot corresponding to the selected aim marker 916*c* in order to achieve the desired 4:1 ratio.

Figure 9B:
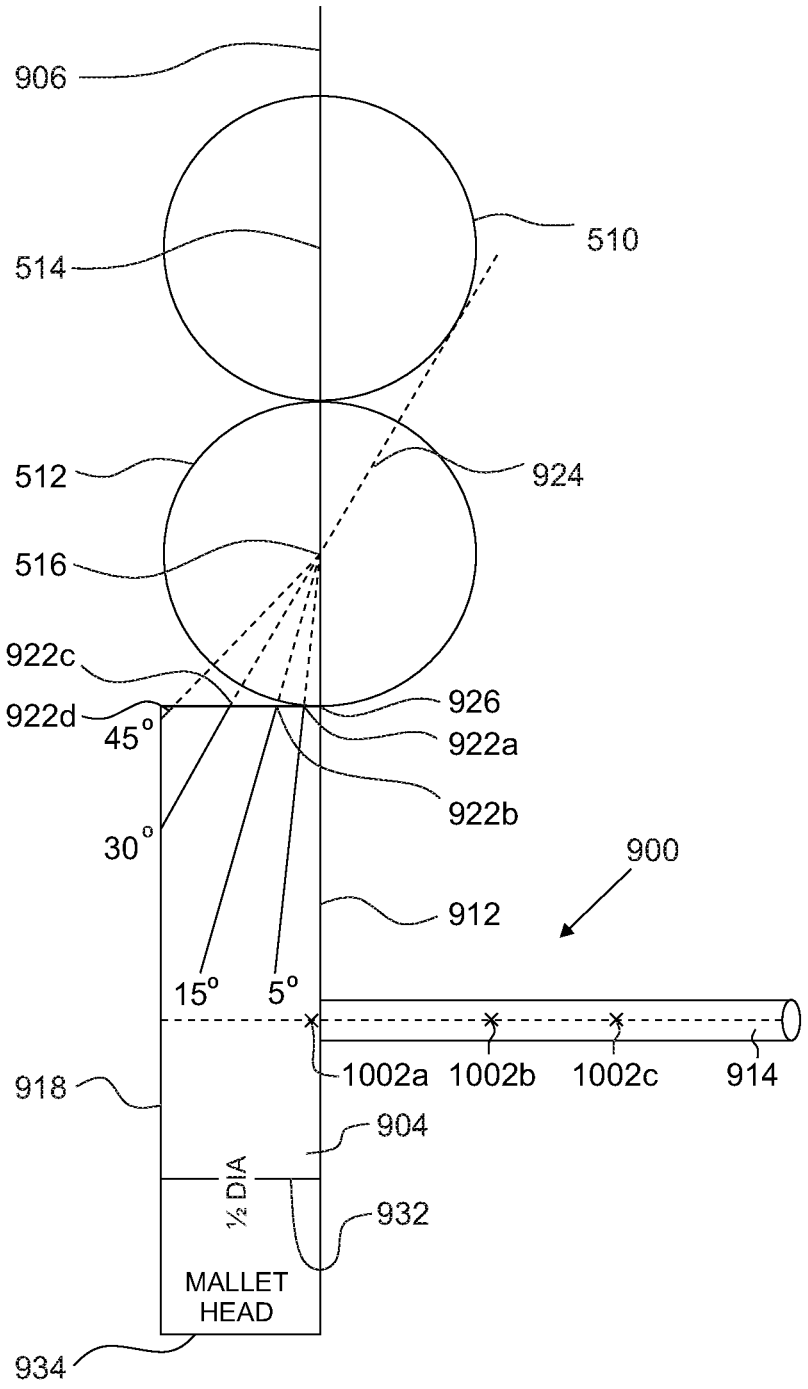
FIG. 9B illustrates a mallet positioned behind a croquet shot such that a second side of the mallet head faces upwards.

FIG. 9B illustrates a second side of the mallet 900 that includes on-mallet playing aids according to one example of the technology. According to one example, the mallet 900 may include a plurality of angle markers 922*a*-922*d* provided along a front edge on a second side of a mallet head 904. According to one example, the angle markers 922*a*-922*d* may be provided on a side face of the mallet head 904. For example, the angle markers 922*a*-922*d* may be printed, etched, or the like, on the side face of the mallet head 904. According to one example, the angle markers 922*a*-922*d* may be provided directly or indirectly on a side face of the mallet head 904. For example, the angle markers 922*a*-922*d* may be printed on a substrate that is affixed to the mallet head 904 using adhesive, epoxy, a magnet, or the like. According to one example, the substrate may be made from plastic, waxed paper, metal, wood, or the like. Alternatively, the angle markers 922*a*-922*d* may be printed on a substrate that forms the mallet head 904. For example, the substrate may include carbon fiber, metal, wood, or other material used to manufacture a mallet head 904. Furthermore, the substrate may include any coating that is applied to a mallet head 904. According to one example, the substrate may be dimensioned to correspond to dimensions of side faces of the mallet head 904. For example, the substrate may be cut to fit the dimensions of side faces of the mallet head 904. According to one example, the substrate may be aligned prior to being affixed to the mallet head 904. Alternatively, the angle markers 922*a*-922*d* may be applied to the substrate during the process of manufacturing of the mallet 900. According to one example, the angle markers 922*a*-922*d* may include lines that extend along a length of the mallet head 904 to facilitate alignment of the mallet head 904 with the croquet and striker balls 510, 512. One of ordinary skill in the art will readily appreciate that the angle markers 922*a*-922*d* may be depicted in other ways that facilitate alignment between the mallet head 904, the croquet ball 510, and the striker ball 512. For example, the mallet head 904 may include angled notches along the front edge at the mallet face.

With reference to FIG. 9B and according to one example, the angle markers 922*a*-922*d* may correspond to half angles based on 30° and 45°, respectively. According to one example, since players tend to divide a striker ball angle in half to obtain a starting point for a mallet angle, the angle markers may include a sequence of angles where each angle is half the preceding angle such as 45°, 22.5°, 11.25°, 5.625°, 2.8125°, and 1.40625°. Alternatively or additionally, the angle markers may include a sequence of angles such as 30°, 15°, 7.5°, 3.75°, 1.875°, and 0.9375°. According to one example, each sequence of angle markers may be depicted using a different color in order to facilitate identification of different angle sequences. According to one example, the angle markers allow a player to identify a desired striker-ball angle and simply move down one angle of a particular color to determine a starting point of the mallet angle. As depicted by the dashed lines extending from each of the angle markers 922*a*-922*d*, the angle markers 922*a*-922*d* may originate from the center 516 of the striker ball 512. One of ordinary skill in the art will readily appreciate that any angle originating from the center 516 of the striker ball 512 may be represented on the mallet head 904.

FIG. 9B further illustrates two balls positioned for taking croquet with the striker ball 512 placed in contact with the croquet ball 510. According to one example, a line 906 is illustrated that extends through a center 514 of the croquet ball 510 and the center 516 of the striker ball 512. The mallet 900 is positioned with the mallet face proximate to the striker ball 512 such that an upper surface 912 of the mallet head 904 is aligned with the line 906. In this arrangement, a dashed line 924 that extends from the angle marker 922*c*, which represents 30°, passes through the center 516 of the striker ball 512 and is tangent to the croquet ball 510. If the upper surface 912 of the mallet head 904 is not aligned with the line 906, then the misalignment may be detected because the dashed line 924 will not extend through the center 516 of the striker ball 512 or will not be tangent to the croquet ball 510.

According to one example, the angle markers 922*a*-922*d* provided on the mallet head 904 perform a similar function to the angle markers of the croquet shot maker 400 positioned along the edge 408 of the half circle area 412A, 412B. More specifically, the angle markers 922*a*-922*d* correspond to the angle markers provided on a left side of the first and second outwardly pointing arrows 407A, 407B when facing inwardly against the the arrows 407A, 407B. In this instance, the striker ball 512 will deviate to the right of the croquet ball 510 after the croquet shot. With reference to FIG. 9A, corner 926 of the mallet head 904 corresponds to a 0° angle marker and the opposite corner on the front face of the mallet head 904 is proximate to the 45° angle marker 922*d*.

According to another example, the mallet head 904 may be marked to identify one or more dimensions that are useful during actual play. Throughout this disclosure, half the diameter of a croquet ball has proven to be useful during actual play. For example, with reference to the single ball shot trainer 200, the first outwardly pointing arrow 207A may be aimed such that the center of the striker ball optimally passes a half diameter behind the desired strike point of the object ball. According to one example, the mallet head 904 may include half diameter marks 930, 932 on first and second sides of the mallet 900, respectively. For example, the half diameter marks 930, 932 may be located substantially 1.8125" from the end face 934. Additionally, or alternatively, the half diameter marks may be located elsewhere on the mallet head 904. During actual play, the mallet 900 may be placed on the ground to determine the half diameter mark. For example, the mallet 900 may be placed directly behind the object ball to visually determine a spot on the ground corresponding to the half diameter marks 930, 932 such as along an extension of the target line that passes through a center of the object ball. The player may note this position on the lawn corresponding to substantially 1.8125" behind the object ball. While the rules prohibit actually marking a point, it may be possible to visually identify perhaps a particular blade of grass, a wear mark, or the like, and then step back and hit the shot aiming at that envisioned mark.

According to another example, the half diameter marks 930, 932 may facilitate the making of hoops through aiding in the identification of a true center of a hoop. As discussed herein, the true center of a hoop is the relevant aiming point for hoop shots. During actual play, the mallet 900 may be placed on the ground along the hoop such that the corresponding half diameter marks 930, 932 may be used to identify a spot on the grass that is the true center of the hoop. A player may then step back and aim the center of the striker ball at this precise point of the hoop. One of ordinary skill in the art will readily appreciate that the mallet 900 may be marked with other dimensions to facilitate play during a game. Furthermore, one of ordinary skill in the art will readily appreciate that the mallet 900 may include other playing aids to facilitate play during a game.

According to one example, the description provided herein may be used to enhance performance of other games that employ balls and an instrument for striking a ball. Examples are described above with the aid of functional building blocks that illustrate the implementation of specified functions and relationships thereof. The boundaries of these functional building blocks have been arbitrarily defined herein for the convenience of the description. Alternate boundaries can be defined so long as the specified functions and relationships thereof are appropriately performed. While the foregoing illustrates and describes examples of this technology, it is to be understood that the technology is not limited to the constructions disclosed herein. The technology may be embodied in other specific forms without departing from its spirit. Accordingly, the appended claims are not limited by specific examples described herein.

What is claimed is:

1. A practice aid for developing croquet skills, the practice aid comprising:

a figure eight-shaped body defined by two conjoined disc-shaped bodies that each include a diameter that is substantially equal to a diameter of a croquet ball;

an aperture provided substantially in a center of each of the disc-shaped bodies, the apertures being dimensioned to receive a croquet ball therein such that the balls contact while provided in the apertures;

an aim marker provided on the figure eight-shaped body that extends through the center of each of the disc-shaped bodies and identifies opposite sides of the figure eight-shaped body; and a plurality of angle markers positioned along an edge of each of the disc-shaped bodies.

2. The practice aid according to claim 1, wherein a first plurality of angle markers define a three-quarter circle or 270° on one of the disc-shaped bodies with a first 0° angle marker provided at one end of the aim marker such that the angle markers increment to 135° on both sides of the first 0° angle and wherein a second plurality of angle markers define a three-quarter circle or 270° on the other of the disc-shaped bodies with a second 0° angle marker provided at the other end of the aim marker such that the angle markers increment to 135° on both sides of the second 0° angle.

3. The practice aid according to claim 2, further comprising:

a third disc-shaped body having a diameter that is substantially equal to a diameter of a croquet ball;

an aperture provided substantially in a center of the third disc-shaped body, the aperture being dimensioned to receive a ball therein such that the ball contacts the croquet ball provided in the figure eight-shaped body;

a cannon aim marker provided on the third disc-shaped body, wherein the cannon aim marker extends across the diameter of the third disc-shaped body and identifies opposite sides of the third disc-shaped body; and a mating portion that is integrally formed with the third disc-shaped body, the mating portion having a concave cutout that is dimensioned to couple to one of the two conjoined disc-shaped bodies of the figure eight-shaped body.

4. The practice aid according to claim 3, wherein at least one of the figure eight-shaped body and the third disc-shaped body include a beveled or sloping surface.

5. The practice aid according to claim 3, wherein at least one of the figure eight-shaped body and the third disc-shaped body include anchor apertures.

6. The practice aid according to claim 1, wherein a center of each aperture corresponds to the center of each of the disc-shaped bodies, the centers of the apertures being separated by a distance that corresponds to substantially a diameter of the croquet ball.

7. The practice aid according to claim 1, further comprising:

a body having an elongated shape, the body including a concave cutout that is dimensioned to couple to the disc-shaped bodies of the figure eight-shaped body; and an alignment marker provided along a middle of the body, the alignment marker having an arrow that points to an edge with the concave cutout, the arrow pointing toward the aperture provided substantially in the center of the corresponding disc-shaped body of the figure eight-shaped body.

8. The practice aid according to claim 1, further comprising:

a third disc-shaped body having a diameter that is substantially equal to a diameter of a croquet ball;

an aperture provided substantially in a center of the third disc-shaped body, the aperture being dimensioned to receive a ball therein such that the ball contacts the croquet ball provided in the figure eight-shaped body;

a cannon aim marker provided on the third disc-shaped body, wherein the cannon aim marker extends across the diameter of the third disc-shaped body and identifies opposite sides of the third disc-shaped body; and a mating portion that is integrally formed with the third disc-shaped body, the mating portion having a concave cutout that is dimensioned to couple to one of the two conjoined disc-shaped bodies of the figure eight-shaped body.

9. A practice aid for developing croquet skills, the practice aid comprising:

a figure eight-shaped body defined by two conjoined disc-shaped bodies that each include a diameter that is substantially equal to a diameter of a croquet ball;

an indentation provided substantially in a center of each of the disc-shaped bodies, the indentations being dimensioned to receive a croquet ball therein such that the balls contact while provided in the indentations;

an aim marker provided on the figure eight-shaped body that extends through the center of each of the disc-shaped bodies and identifies opposite sides of the figure eight-shaped body; and a plurality of angle markers positioned along an edge of each of the disc-shaped bodies.

10. The practice aid according to claim 9, wherein a first plurality of angle markers define a three-quarter circle or 270° on one of the disc-shaped bodies with a first 0° angle marker provided at one end of the aim marker such that the angle markers increment to 135° on both sides of the first 0° angle and wherein a second plurality of angle markers define a three-quarter circle or 270° on the other of the disc-shaped bodies with a second 0° angle marker provided at the other end of the aim marker such that the angle markers increment to 135° on both sides of the second 0° angle.

11. The practice aid according to claim 10, further comprising:

a third disc-shaped body having a diameter that is substantially equal to a diameter of a croquet ball;

an indentation provided substantially in a center of the third disc-shaped body, the indentation being dimensioned to receive a ball therein such that the ball contacts the croquet ball provided in the figure eight-shaped body;

a cannon aim marker provided on the third disc-shaped body, wherein the cannon aim marker extends across the diameter of the third disc-shaped body and identifies opposite sides of the third disc-shaped body; and a mating portion that is integrally formed with the third disc-shaped body, the mating portion having a concave cutout that is dimensioned to couple to one of the two conjoined disc-shaped bodies of the figure eight-shaped body.

12. The practice aid according to claim 11, wherein at least one of the figure eight-shaped body and the third disc-shaped body include a beveled or sloping surface.

13. The practice aid according to claim 11, wherein at least one of the figure eight-shaped body and the third disc-shaped body include anchor apertures.

14. The practice aid according to claim 9, wherein a center of each indentation corresponds to the center of each of the disc-shaped bodies, the centers of the indentations being separated by a distance that corresponds to substantially a diameter of the croquet ball.

15. The practice aid according to claim 9, further comprising:

a body having an elongated shape, the body including a concave cutout that is dimensioned to couple to the disc-shaped bodies of the figure eight-shaped body; and an alignment marker provided along a middle of the body, the alignment marker having an arrow that points to an edge with the concave cutout, the arrow pointing toward the indentation provided substantially in the center of the corresponding disc-shaped body of the figure eight-shaped body.

16. The practice aid according to claim 9, further comprising:

a third disc-shaped body having a diameter that is substantially equal to a diameter of a croquet ball;

an indentation provided substantially in a center of the third disc-shaped body, the indentation being dimensioned to receive a ball therein such that the ball contacts the croquet ball provided in the figure eight-shaped body;

a cannon aim marker provided on the third disc-shaped body, wherein the cannon aim marker extends across the diameter of the third disc-shaped body and identifies opposite sides of the third disc-shaped body; and a mating portion that is integrally formed with the third disc-shaped body, the mating portion having a concave cutout that is dimensioned to couple to one of the two conjoined disc-shaped bodies of the figure eight-shaped body.

* * * * *